US008206059B1

(12) United States Patent
Southgate et al.

(10) Patent No.: US 8,206,059 B1
(45) Date of Patent: Jun. 26, 2012

(54) LOAD TRANSFER ASSEMBLY

(76) Inventors: Herbert F. Southgate, Lexington, KY (US); Kamyar C. Mahboub, Lexington, KY (US); Alireza Zeinali, Lexington, KY (US)

( * ) Notice: Subject to any disclaimer, the term of this patent is extended or adjusted under 35 U.S.C. 154(b) by 0 days.

(21) Appl. No.: 13/232,144

(22) Filed: Sep. 14, 2011

(51) Int. Cl.
*E01C 11/14* (2006.01)

(52) U.S. Cl. ..... 404/60; 404/56

(58) Field of Classification Search ..... 404/47–70
See application file for complete search history.

(56) References Cited

U.S. PATENT DOCUMENTS

| | | | | |
|---|---|---|---|---|
| 2,108,393 | A | 2/1938 | Schulz | |
| 2,207,085 | A | 7/1940 | Brickman | |
| 2,489,851 | A * | 11/1949 | Bean | 249/9 |
| 2,509,663 | A | 5/1950 | Yeoman | |
| 2,552,831 | A | 5/1951 | Yeoman | |
| 2,654,297 | A * | 10/1953 | Nettleton | 404/52 |
| 4,191,489 | A | 3/1980 | Ray et al. | |
| 4,648,739 | A * | 3/1987 | Thomsen | 404/2 |
| 4,752,153 | A * | 6/1988 | Miller | 404/59 |
| 4,883,385 | A | 11/1989 | Kaler | |
| 5,487,249 | A * | 1/1996 | Shaw et al. | 52/396.02 |
| 6,145,262 | A | 11/2000 | Schrader et al. | |
| 6,171,016 | B1 | 1/2001 | Pauls et al. | |
| 6,517,277 | B2 | 2/2003 | Hu et al. | |
| 7,223,046 | B1 * | 5/2007 | Lim | 404/53 |
| 7,334,963 | B2 | 2/2008 | Costa et al. | |
| 7,381,008 | B2 | 6/2008 | Shaw et al. | |
| 7,441,985 | B2 | 10/2008 | Kelly et al. | |
| 7,806,624 | B2 | 10/2010 | McLean et al. | |
| 2004/0107661 | A1 * | 6/2004 | Michiels | 52/396.05 |
| 2005/0036835 | A1 | 2/2005 | Shaw et al. | |
| 2005/0232697 | A1 * | 10/2005 | Brinkman | 404/47 |
| 2005/0276660 | A1 | 12/2005 | McLean et al. | |
| 2006/0177268 | A1 | 8/2006 | Kramer | |
| 2006/0177269 | A1 | 8/2006 | Kramer | |
| 2006/0204329 | A1 | 9/2006 | Costa et al. | |
| 2007/0134063 | A1 * | 6/2007 | Shaw et al. | 404/62 |
| 2007/0269266 | A1 | 11/2007 | Kelly et al. | |
| 2008/0222984 | A1 | 9/2008 | Michiels | |
| 2010/0325996 | A1 | 12/2010 | Laiho et al. | |

* cited by examiner

*Primary Examiner* — Raymond W Addie
(74) *Attorney, Agent, or Firm* — King & Schickli, PLLC

(57) ABSTRACT

A load transfer apparatus accommodates movement between adjacent concrete slabs. The load transfer apparatus includes a spine in a form of an elongated hinge having a longitudinal axis A. A first dowel and a second dowel project radially from the spine and are located at two spaced points along said longitudinal axis A.

20 Claims, 47 Drawing Sheets

LOAD TRANSFER ASSEMBLY

TECHNICAL FIELD

The present invention relates generally to load transfer devices and, more particularly, load transfer devices for transferring loads between adjacent slabs of concrete.

BACKGROUND

An advantage of portland cement concrete (PCC) pavement is, among others, the low deflection under traffic load due to the high modulus of elasticity of concrete. Pavements expand and shrink due to environmental conditions, among others. PCC pavements may be constructed with joints between slabs. The joints may provide space to accommodate the movement of slabs during expansion and shrinkage.

Concrete slabs may bow and or curve due to, among other factors, temperature induced differential expansion/contraction, gravity, structural loads, and/or pressure from the ground below. This curving and bowing may be referred to as slab deflection. Slab deflection may be uneven across the surface of the slab, for example, deflection may be greater at the joints than in the interior slab regions. This uneven deflection may result in greater damage occurring at or near joints. To address and reduce slab damage near the joints, a load transfer system may be used to link adjacent slabs together. Load transfer between slabs is crucial to pavement performance and most performance problems with concrete pavements result from poorly performing joints. Distresses such as faulting, pumping and corner breaks occur in part due to joints with poor load transfer efficiency.

The load transfer across the joints may be achieved with aggregate interlock between two faces of the joint or using dowel bars, or both. To mobilize aggregate interlock, the concrete slab may be allowed to crack naturally below the saw cut locations. Under this method, the irregular fracture surface below the joint offers aggregate interlock, which helps with load transfer between slabs. Aggregate interlock is highly influenced by climatic conditions. Therefore, aggregate interlock is adequate only for roads and streets with a low volume of traffic and light trucks. Where the traffic volume increases beyond the load carrying capacity of the pavement, aggregate interlock joints may be retrofitted by dowel bar as the traffic increases (FHWA, 1990)

BRIEF SUMMARY

A load transfer apparatus is provided for accommodating movement between adjacent concrete slabs including, but not limited to movement due to expansion and contraction of the slabs, movement due to traffic and movement due to daily temperature fluctuations. The apparatus comprises a dowel bar having a first end, a second end and a freely rotating hinge provided along an intermediate section of the dowel bar between the first end and the second end. The apparatus further includes a first dowel bar sleeve and a second dowel bar sleeve. The first dowel bar sleeve is held in a first concrete slab of the adjacent concrete slabs while a second dowel bar sleeve is held in a second concrete slab of the adjacent concrete slabs. The first end of the dowel bar is slidingly received in the first sleeve while the second end of the dowel bar is slidingly received in the second sleeve. The dowel bar may be coated with a low friction non-stick material to minimize frictional resistance and better ensure freedom of movement of the apparatus to accommodate movement of the adjacent concrete slabs.

In accordance with another aspect, the load transfer apparatus may be described as comprising a spine and a plurality of dowel bars projecting from the spine where the spine comprises an elongated, freely rotating hinge. The hinge includes a first tube and a second tube wherein the first tube nests within the second tube while allowing for free rotation with respect to the second tube. A plug or cap is provided at each end of the first tube in order to keep fresh concrete out of the tube.

Each of the plurality of dowel bars includes a first end and a second end. The first end of each dowel bar is connected to the first tube while the second end of each dowel bar is connected to the second tube. Further, the second tube includes a slot and the first end of each dowel bar extends through that slot in the second tube. The ends of the dowel bars are received in opposed dowel bar sleeves held in the adjacent concrete slabs. At least one ridge projects from the second tube in a substantially vertical plane in a joint formed between a first concrete slab and a second concrete slab of the adjacent concrete slabs.

Still further, the load transfer apparatus may be described as comprising a spine in the form of an elongated hinge having a longitudinal axis A. A first dowel at a first point of the spine radially projects from the spine in two opposed directions. A second dowel at a second point of the spine also radially projects in those two opposed directions. The first point is spaced from the second point along the longitudinal axis A. In addition, the adjacent concrete slabs are separated by a joint and the spine and longitudinal axis are aligned with that joint between the adjacent concrete slabs.

In the following description there is shown and described a preferred embodiment of load transfer apparatus. As it will be realized, the load transfer apparatus is capable of other different embodiments and its several details are capable of modification in various, obvious aspects. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the load transfer apparatus and together with the description serves to explain the principles thereof. In the drawing.

Reference will now be made in detail to the present preferred embodiment of the load transfer apparatus illustrated in the accompanying drawing.

DETAILED DESCRIPTION OF THE DRAWINGS

Figure 1:
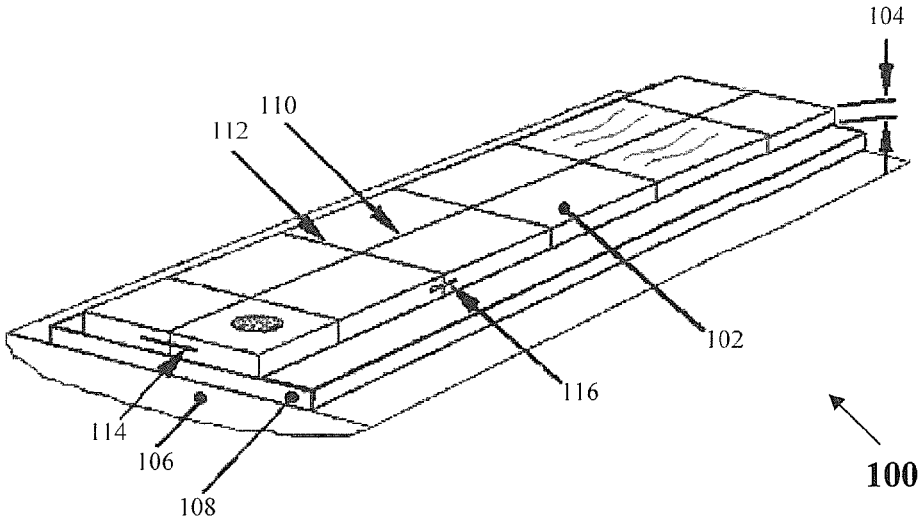
(PRIOR ART) FIG. 1
FIG. 1 is a perspective view of a prior art concrete pavement.

FIG. 1 shows an exemplary prior art concrete pavement 100. A concrete pavement 100 may be constructed of numerous slabs 102. Each slab 102 may have a thickness 104. The thickness 104 may be about 5 inches to about 20 inches. The concrete slab concrete pavement 100 may be laid on top of a prepared subgrade 106 which may include, for example but not limited to, compacted natural soil or stabilized soil and/or a subbase or base 108 which may include, for example but not limited to, granular material, cement treated aggregate, or asphalt treated aggregate. Concrete slabs 102 may be joined together at joints, for example longitudinal joints 110 and transverse joints 112. Tie bars 114 may be used to join one or more concrete slabs 102. Tie bars 114 may include, among others, steel or polymer bars. Concrete slabs 102 may also include dowel bars 116.

Dowel bars 116 may be short steel bars (e.g., 2.54-3.81 cm in diameter). Although steel is listed herein, dowel bars 116 may also be constructed of other materials, such as but not limited to, fiber reinforced polymers. Dowel bars 116 may be used in load transfer systems, such as load transfer between two concrete slabs 102 across a joint 112. Dowel bars 116 are used because they may permit load transfer without restricting the horizontal movement of the joint 112. For example, when pavement 100 is loaded by heavy vehicles, dowel bars 116 may participate in carrying the load, and may reduce the slab joint deflection.

Figure 2A:
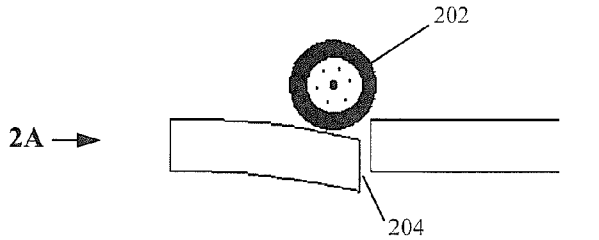
(PRIOR ART) FIG. 2A
FIGS. 2A and 2B are schematical illustrations of prior art concrete slabs undergoing deflection due to load.
Figure 2B:
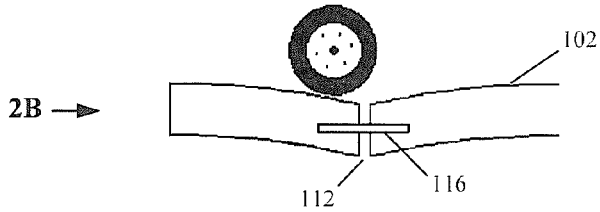
(PRIOR ART) FIG. 2B

FIGS. 2A and 2B illustrate the use of dowel bars 116 to permit load transfer. FIG. 2A illustrates two concrete slabs 102 that do not include a dowel bar 116 across the joint 204. In this illustration, the load 202, causes a concrete slab 102 to deflect. FIG. 2B illustrates two concrete slabs 102 that are joined by a dowel bar 116 at a joint such as shown in FIG. 1, 112. In this example, as the load 202 travels across a slab 102 the dowel bar 116 participates carrying the load 202 such that deflection is minimized.

To prevent corrosion, dowel bars 116 may be made of, for example but not limited to, stainless steel or polymers. Additionally or alternatively, the dowel bars 116 may be coated with, for example but not limited to, epoxy or TEFLON. Dowel bars 116 may be positioned at mid-slab 102 depth and may also be coated with a bond-breaking agent to allow horizontal slab movement. Dowel bars 116 may help transfer vertical traffic load and may also allow adjacent slabs to expand/contract and move horizontally independent of one another (WSDOT, 2010).

A poorly functioning load transfer system may result in excessive cracking at concrete joints. Concrete joint deterioration, for example but not limited to cracking, may take place on the bottom of the concrete slab 102 and may not be visible from the surface. Simple dowel bars 116 may transfer a load 202 from one slab 102 to an adjacent slab 102, which may generate high shear stress in the vicinity of the dowel bars 116.

Figure 3:
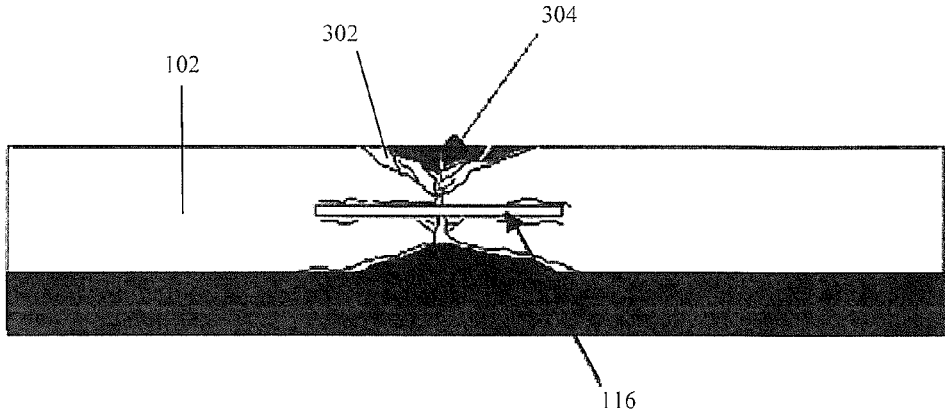
(PRIOR ART) FIG. 3
FIG. 3 is a schematical illustration of a prior art concrete slab undergoing spalling.

FIG. 3 illustrates one way in which prior art slabs 102 may break up, flake, or become pitted, which may be referred to as spalling 304. Shear cracks 302 may grow as, for example, shear stress increases, which may result in concrete spalling 304 around the joint 112. Concrete spalling 304 at joints 112 may result in deep damage, which may require a full depth patch to repair the pavement 100; this is a very costly maintenance operation.

Full depth concrete pavement 100 patching repair includes removal of the distressed portion of pavement 100 and replacing it with fresh concrete material. Since full depth patching is a typical rehabilitation method for concrete pavements 100, most states have provided standard instructions and manuals to address this issue. Various steps in full depth repair are discuss and illustrated in (Pierce L. M., Muench S. T., (2009), *Evaluation of Dowel Bar Retrofit for Long-Term Pavement Life in Washington State*, Washington State Department of Transportation, Office of Research and Library Services), which is incorporated herein in its entirety. Again, this is a very costly operation.

Misalignment of dowel bars 116 may also result in damage that requires costly repairs. For example, if dowel bars are not aligned perpendicular, and in further example, exactly perpendicular, to the joint 112, they may constrain the contraction of slabs 102 and cause cracking in pavement 100. Misaligned dowel bars 116 may have to bend as the joint 112 opens and the result may impose large tensile stresses in concrete. Corrosion may also result in further distress and cracking and spalling 304 in concrete. To address the issue of spalling 304, Schrader (1991) proposed a dowel bar system with square section and flexible material attached to the sides to help with the joint excessive movement and dowel misalignment problems. Schrader E. K., (1991), *Solution to cracking and stresses caused by Dowels and tie bars*, Concrete International, V.13, Issue 7, pp. 40-45, incorporated herein in its entirety.

Schrader's proposed method addresses only flexibility of the joint system in a direction parallel to the joint. Schrader's method does not address shear stresses in the concrete in a direction perpendicular to the slab. Therefore, the present load transfer apparatus is superior to the system proposed by Schrader (1991).

The disclosed hinged dowel bar load transfer system may reduce the level of shear stress around the slab joints 112. High shear stress may cause damage in pavement 100, such as concrete pavement or rigid pavement, and increase the maintenance costs. A hinged dowel bar load transfer system may include dowel bars 116 with a hinge at their mid-span. Finite element computer modeling analyses showed that the hinged dowel bar load transfer system reduces shear stress by approximately 15%-20% when compared to the current practice of using dowel bars 116 without a hinge.

Figure 4:
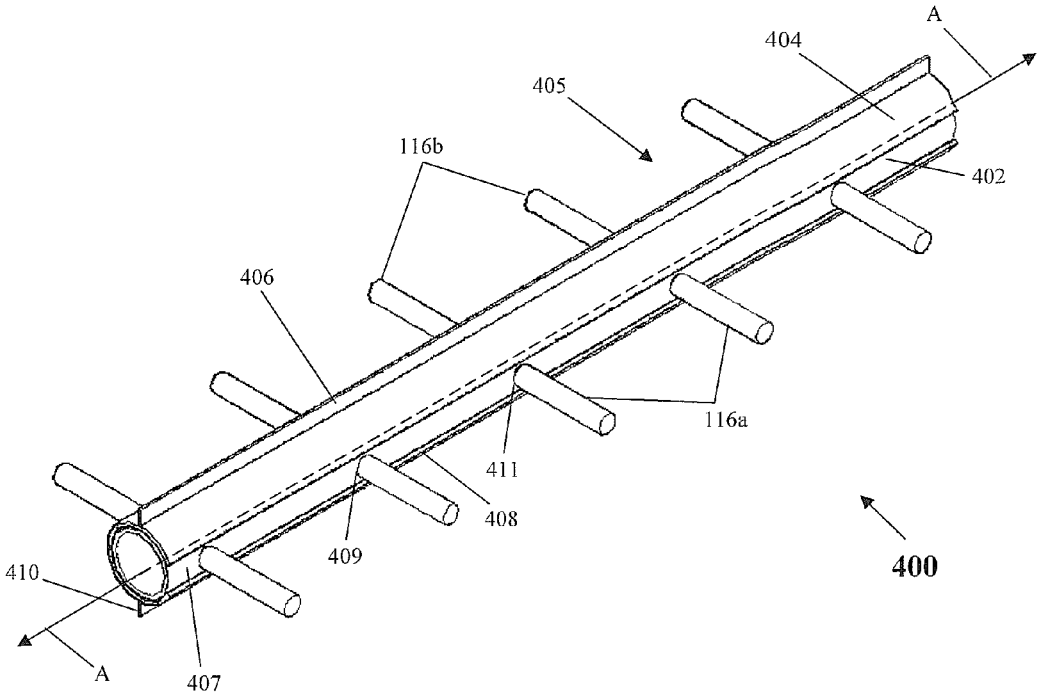
FIG. 4 is a perspective view of the load transfer assembly that is the subject of this document.
Figure 5:
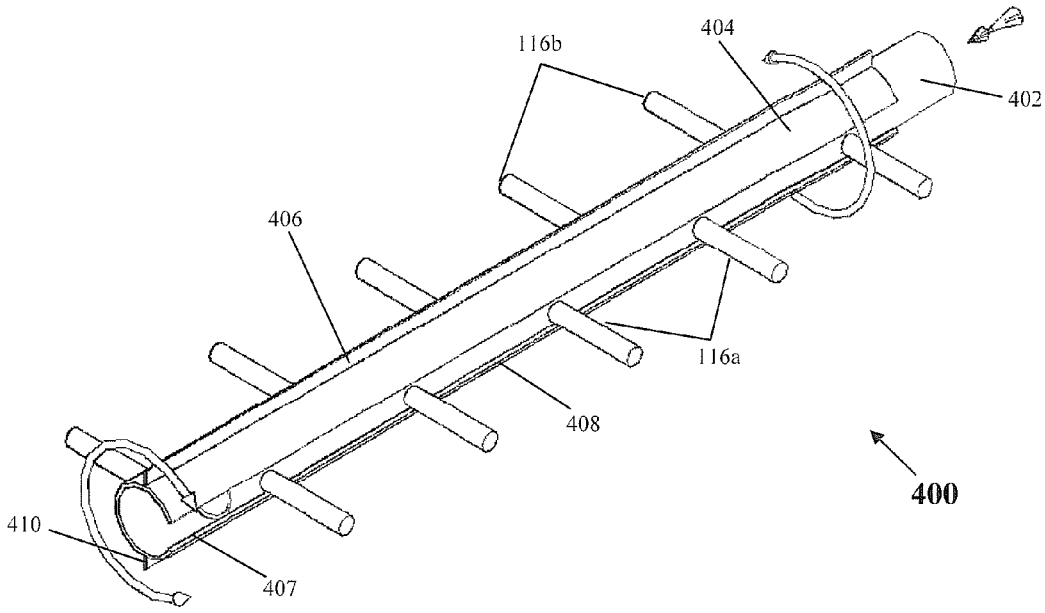
FIG. 5 is a view similar to FIG. 4 but illustrating the freely rotating movement of hinge with action arrows.

FIG. 4 is one example of one variation of a load transfer system. In one variation, the load transfer system may be, for example, a coupled-pipe-type 400 system. A coupled-pipe-type load transfer system 400 may include, but is not limited to an inner pipe 402 and an outer pipe 404. The inner pipe 402 may be nested within the outer pipe 404 such that both the inner pipe 402 and the outer pipe 404 are freely rotatable, as shown in FIG. 5. Thus, the inner and outer pipes 402, 404 form a spine or freely rotating hinge 405. Dowel bars 116 extend from that spine 405 at spaced locations. The spine or hinge 405 is elongated with respect to the dowel 116. More specifically, each dowel bar 116 includes a first end 116*a* and a second end 116*b*. The first end 116*a* is connected to and projects from the inner tube 402 while the second end 116*b* is connected to and projects from the second tube 404. The second tube 404 also includes a slot 407 opposite the second ends 116*b* of the dowel bars 116. The first ends 116*a* of the dowel bars extend through that slot 407.

Described another way, the load transfer apparatus 400 comprises a spine in the form of an elongated, freely rotating hinge 405 having a longitudinal axis A (see FIG. 4). A first dowel bar 116 is connected to the spine 405 at a first point 409. A second dowel bar 116 is connected to the spine 405 at a second point 411 where the first point 409 is spaced from the second point 411 along the longitudinal axis A of the spine 405. The spine 405 may be of substantially any length to support multiple transversely aligned dowel bars 116 including but not limited to 45.72 cm, 91.44 cm, 182.88 cm and 365.76 cm.

In this example variation, the coupled-pipe-type load transfer system 400 may allow load transfer between slabs by shear resistance of the load transfer system in the direction perpendicular to the slab plane while minimizing shear stresses induced into the slabs.

The inner pipe 402 and the outer pipe 404 of the coupled-pipe-type 400 load transfer system may be removably coupled together using pipes (or tubular steel sections) as shown in FIG. 4. For example, the outer pipe 404 may have a top side 406, which may be the side that—when installed between two or more slabs 102—faces away from the ground. The outer pipe 404 may have a bottom side 408, which may be the side that—when installed between two or more slabs 102—faces toward the ground.

The outer pipe 404 may include one or more ridges 410 that radially project from the spine or hinge 405, which may be vertical ridges. For example, the outer pipe may have a first ridge 410 at the top side 406 and a second ridge 410 at the bottom side 408 of the outer pipe 404. The ridges may be made of, for example, but not limited to, steel strips.

Ridges 410 may encourage the development of shrinkage cracking in a localized fashion, which may lead to the formation of well defined slab joints. The coupled-pipe-type 400 load transfer system may be made with any number of dowel bars (for example, but not limited to 1, 2, 3, 5, or 10+ dowel bars 116) and transported to the construction site in an assembled form such as illustrated in FIG. 4. The ends of the second or outer pipe 404 may include caps 1415 to keep concrete out of the pipes 402, 404 and hinge 405 (see FIGS. 11A-11C).

Prefabrication of the dowel bars 116 with the coupled-pipe-type 400 dowel bar system may facilitate ease of installation of the dowel bars 116 with slabs 102 at the construction site, thereby reducing time and cost (e.g., manpower, labor, and down-time on the roadway) as compared to traditional dowel assemblies. The inner pipe 402 and outer pipe 404 of the coupled-pipe-type 400 dowel bar may be installed as shown in FIG. 5. Additionally, FIG. 5 illustrates the ease of rotation and/or insertion. The coupled-pipe-type dowel bar system 400 may more efficiently transfer traffic induced loads and environmentally induced curling and warping loads to the adjacent slabs 102. When compared to traditional dowel bars, the disclosed load transfer system better distributes the load among concrete slabs and reduces concentration of shear stresses as is shown by finite element analysis. Arrangement of the dowel bars into, for example, the coupled-pipe-type 400 load transfer system, give slabs a degree of rotational freedom. As a result, the pressure on the dowel bars at the points they enter the concrete slabs may decrease and which may lessen the shear stress inside concrete slabs.

Figure 6:
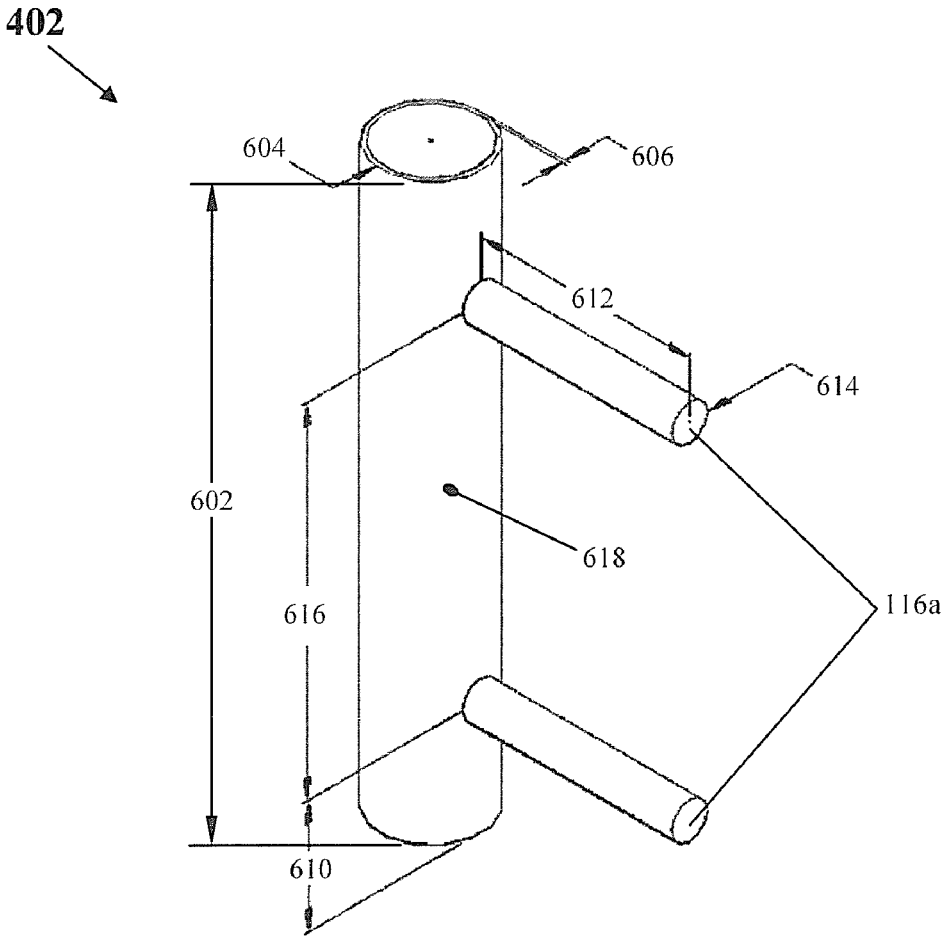
FIG. 6 is a detailed perspective view of the inner pipe.
Figure 7:
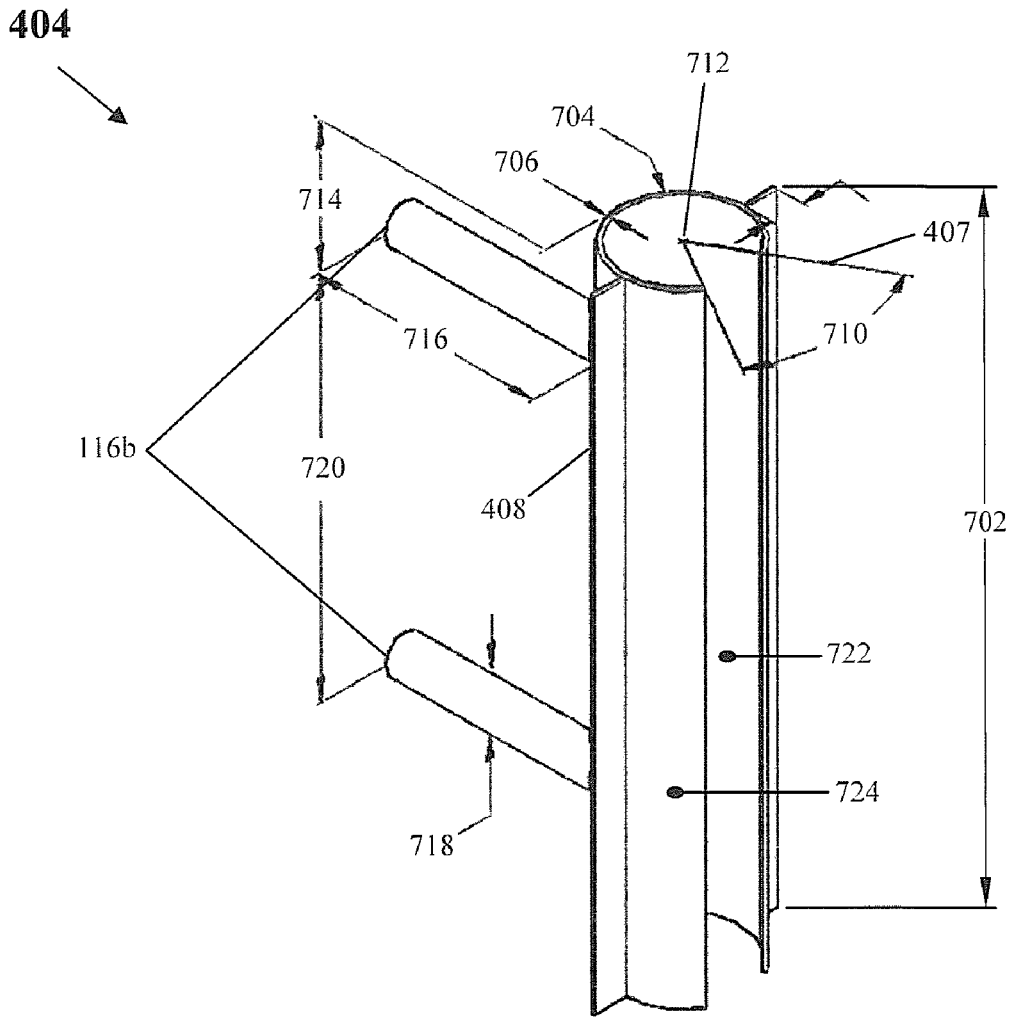
FIG. 7 is a detailed perspective view of the outer pipe.
Figure 8A:
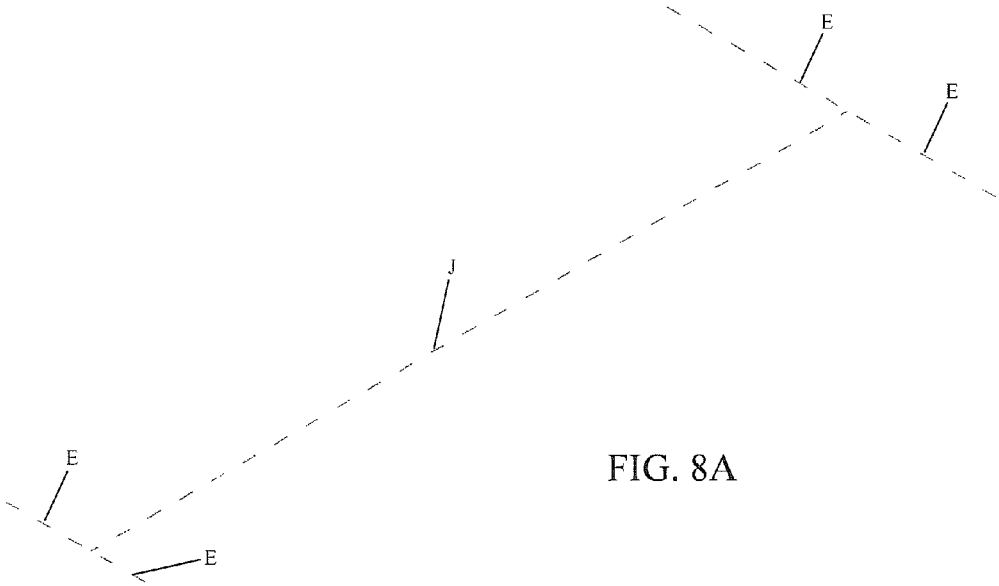
FIGS. 8A-8D are schematical perspective views illustrating the step-by-step use of the load transfer assembly in original road construction.
Figure 8B:
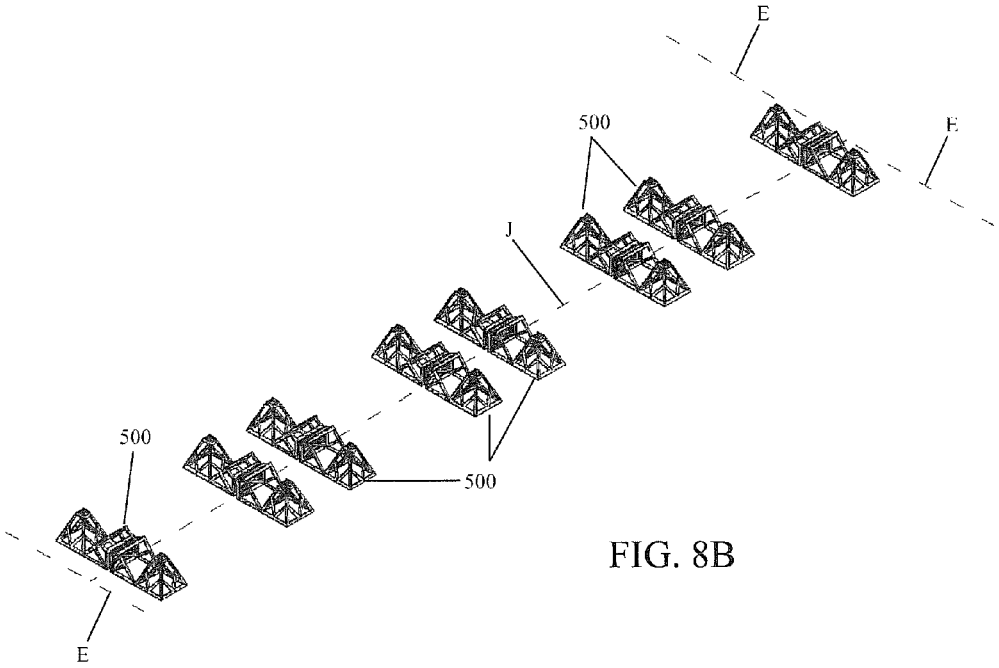
Figure 8C:
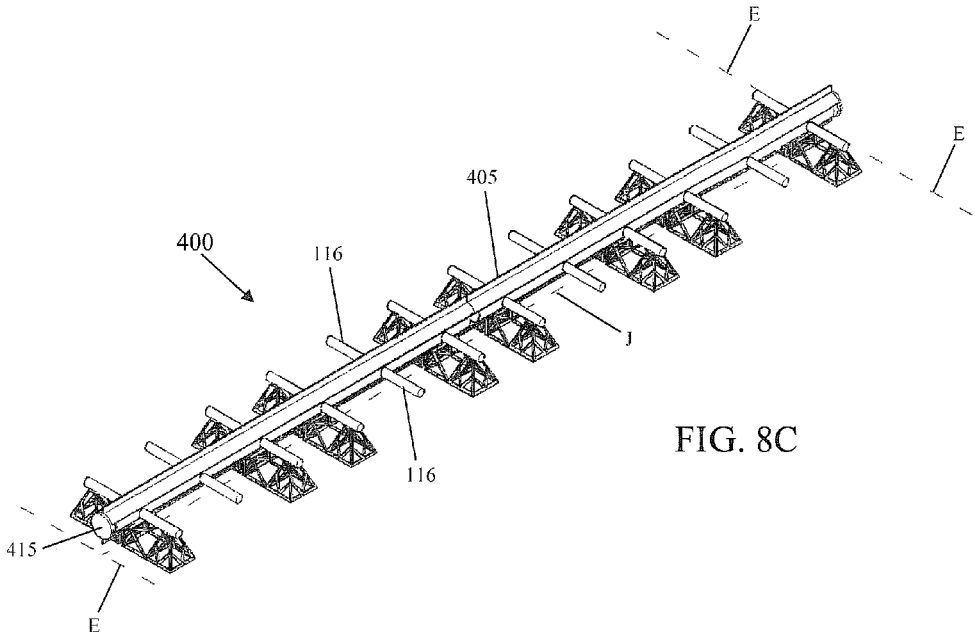
Figure 8D:
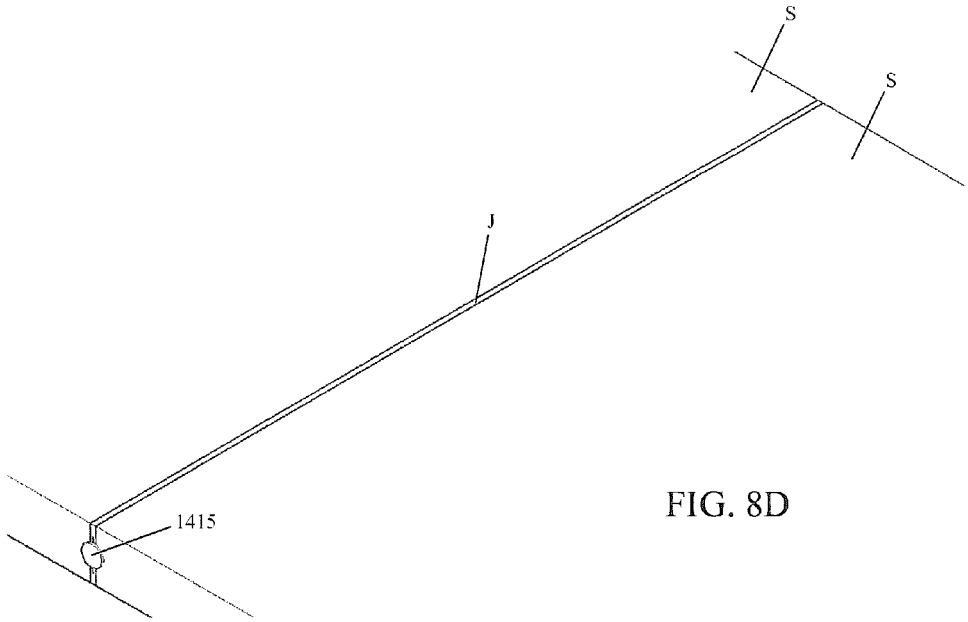
Figure 9A:
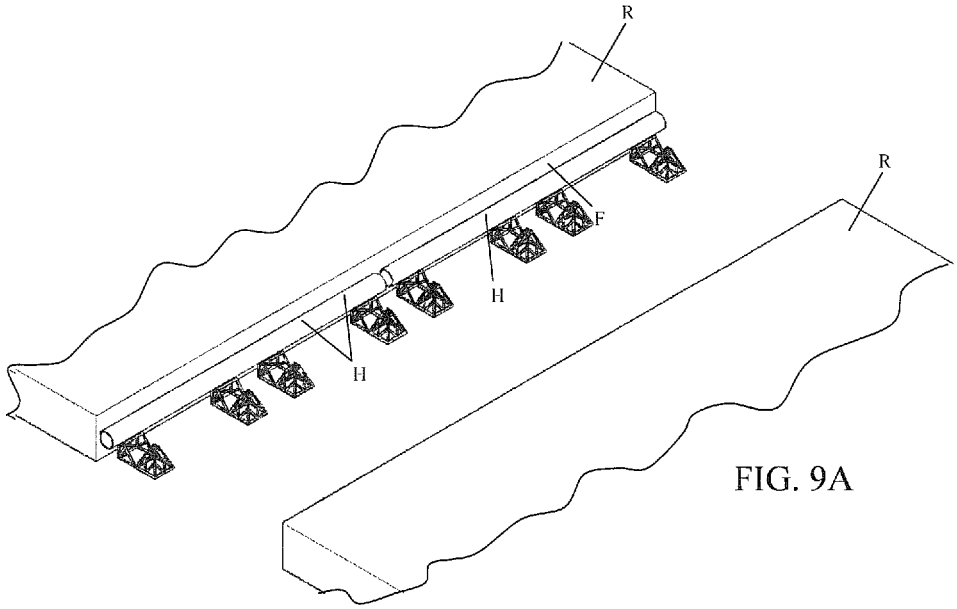
FIGS. 9A-9F are schematical perspective views illustrating the step-by-step use of the load transfer assembly to repair an existing concrete roadway.
Figure 9B:
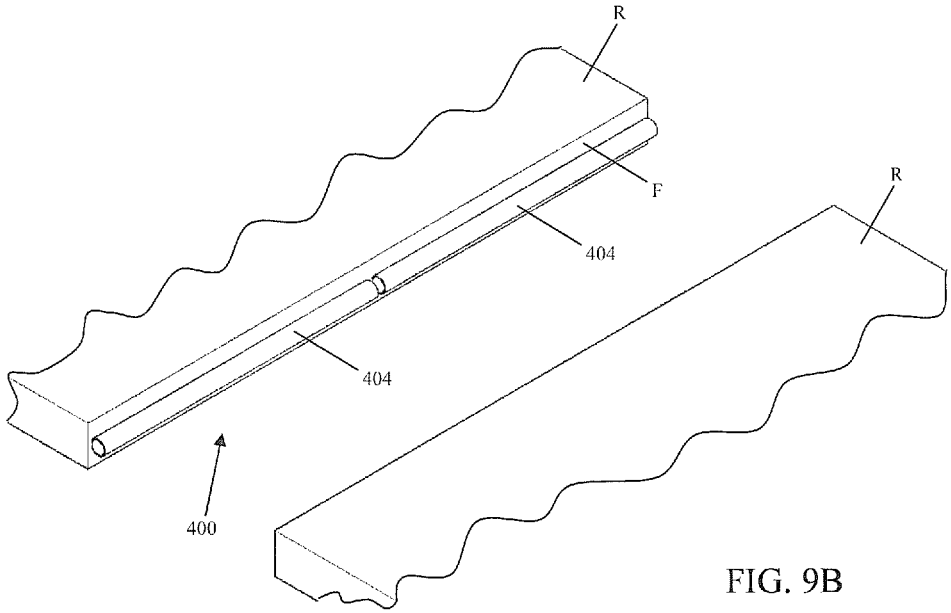
Figure 9C:
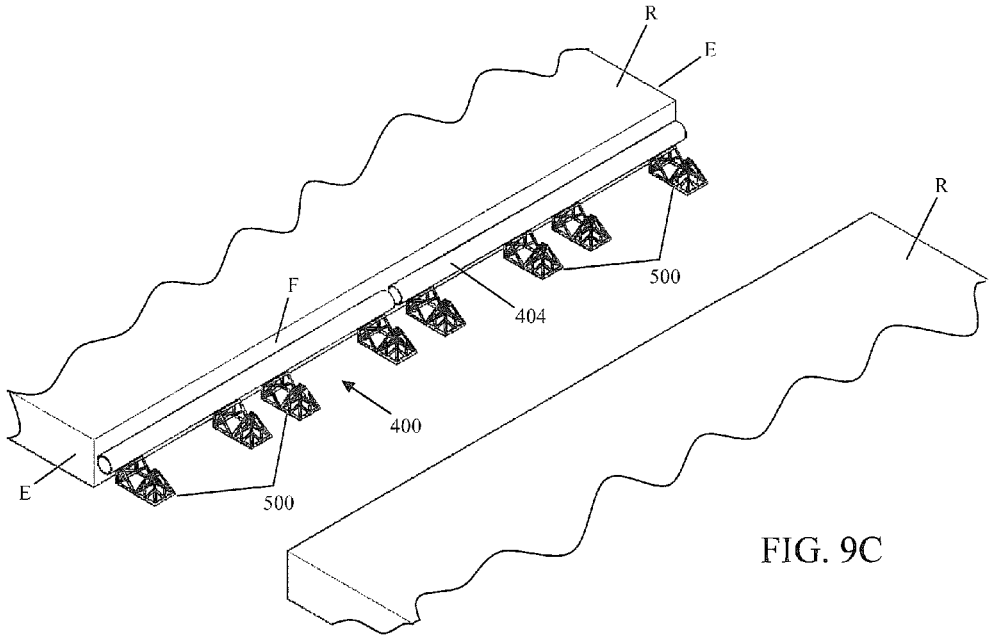
Figure 9D:
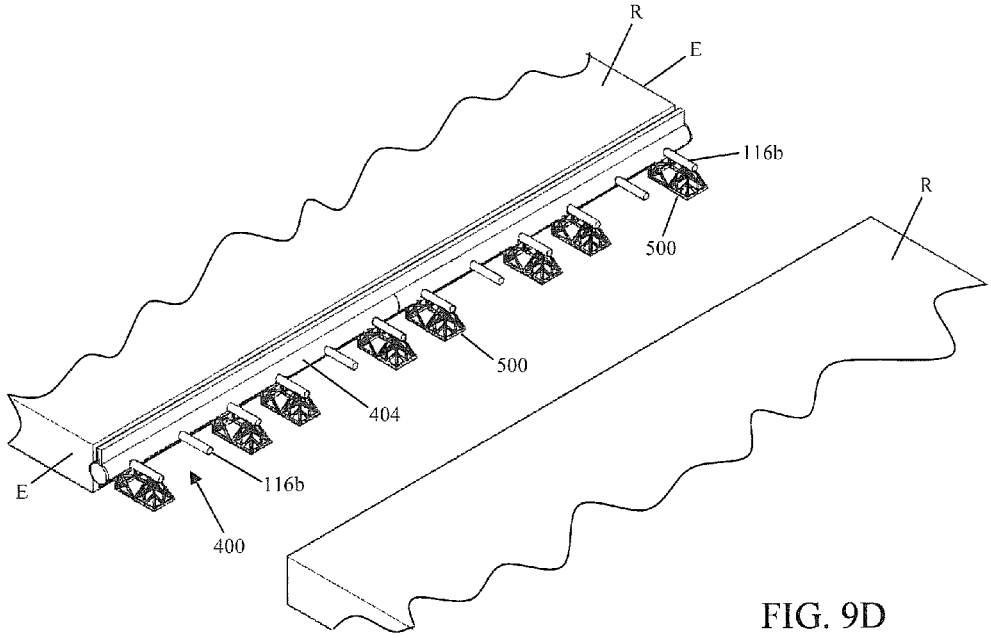
Figure 9E:
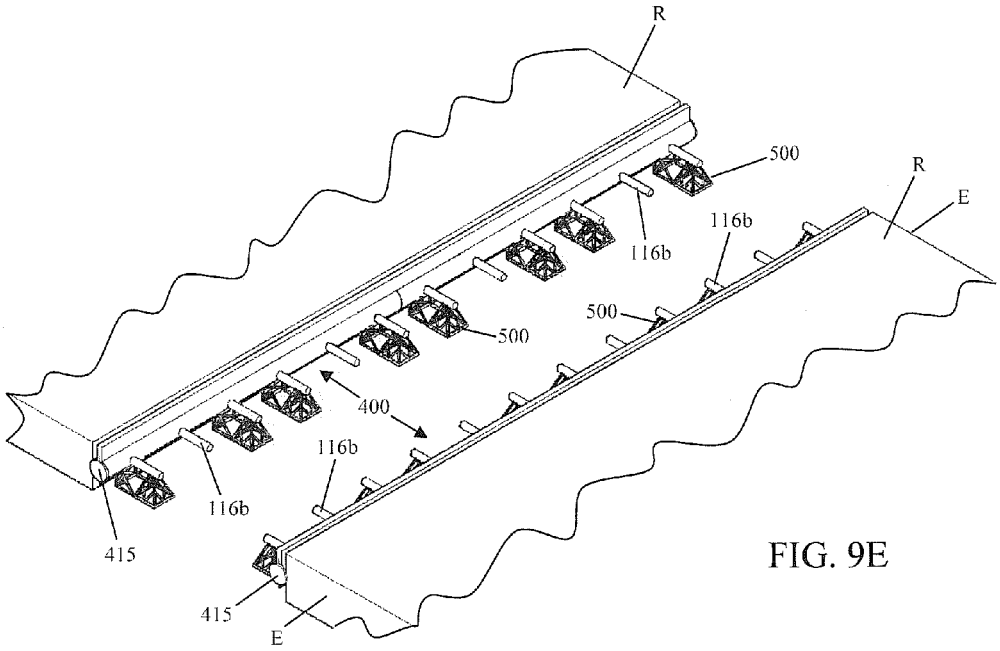
Figure 9F:
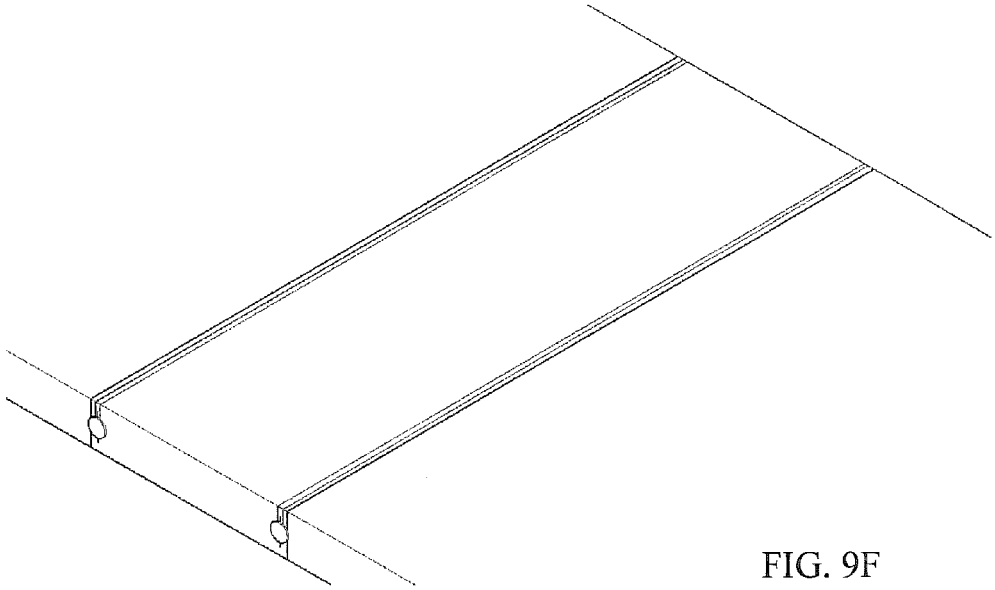

The proposed load transfer system may be easily manufactured to meet common design and standards of practice. FIGS. 6 and 7 provide illustrative dimensions for one variation of a coupled-pipe-type 400 system. This example is merely for illustrative purposes and is not meant to be limiting. Other variations of dimensions may of course be used and may depend on factors such as materials used, road used, environment, budget and other factors. These variations are considered within the scope of this invention.

FIG. 6 illustrates example dimensions for an example inner pipe FIG. 4, 402. As described above, in this example, an inner pipe 402 may have a length 602 of, for example but not limited to about 45.72 cm. The inner pipe 402 may have an outer diameter 604 of, for example but not limited to, about 9.14 cm. The inner pipe may have a pipe-wall thickness 606 of, for example, but not limited to, 0.30 cm.

The inner pipe 402 may have dowel bar ends 116*a* arranged approximately perpendicular. The dowel bar ends 116*a* may be located at distance 610 from each end of the inner pipe 402. For example, the distance 610 may be, approximately 7.62 cm. The distance may be greater or lesser depending on other parameters such as materials, road conditions, weather conditions, and other factors. In this example, each dowel bar end 116*a* may have a length 612 of approximately 18.42 cm and a width or diameter 614 of between about 2.0 and about 4.0 cm and typically about 3.175 cm. The dowel bar ends 116*a* on the inner pipe 402 may be located at distance 616 from adjacent dowel bars. Distance 616 may be, among other dimensions, approximately 30.48 cm. The inner pipe 402 may have an outer surface 618. The outer surface 618 may be coated with a material that has the properties of, for example but not limited to, reducing friction, preventing or retarding corrosion, preventing a bond between concrete and pipe, or other properties. For example, the outer surface 618 may be coated with TEFLON, or other materials.

In FIG. 7, an example outer pipe FIG. 4, 404 may have dowel bar ends 116*b* arranged approximately perpendicular to the length 702 of the outer pipe 404. The length 702 of the outer pipe 404 may be approximately 45.72 cm. The outer pipe 404 may have an outer diameter 704 of approximately 10.16 cm. The wall thickness 706 may be approximately 0.574 cm. The slot or opening 407 in the outer pipe 404 is dimensioned to subscribe an arc 710 of 60° when measure from the center 712 of the outer pipe 404.

The outer pipe 404 may have dowel bar ends 116*b* arranged approximately perpendicular. The dowel bar ends 116*b* may be located at distance 714 from each end of the outer pipe 404. For example, the distance 714 may be, approximately 7.62 cm. The dowel bar ends 116*b* may have a length 716 of approximately 17.78 cm and a diameter 718 of approximately 3.175 cm. The dowel bar ends 116*b* on the outer pipe 404 may be located at distance 720 from adjacent dowel bar ends. Distance 720 may be, among other dimensions, approximately 30.48 cm.

It should be appreciated that the elongated hinge 405 (and, more particularly, the longitudinal axis A of the hinge) has a length $L_H$ significantly longer than the diameter or width W of the dowel bar 116. In fact, the length $L_H$ is at least two times, more preferably ten times and still more preferably 12 to 20 times that of the width W. Further, the length $L_H$ of the elongated hinge 405 is greater than the length $L_B$ of the dowel bar 116. Significantly, the great length of the elongated hinge 405 helps to insure that the apparatus 400 can be properly aligned along the joint between concrete slabs and maintained in proper position during the pouring and setting of concrete for those slabs. Proper alignment is necessary to prevent binding of the hinge 405 and to provide maximum stress relief to the concrete slabs as they bow and curve due to various factors including but not limited to temperature induced expansion and contraction, gravity, structural loads and/or pressure from the ground below.

The outer pipe 404 may have an inner surface 722 and an outer surface 724. The inner surface 722 and or the outer surface 724 may be coated with a material that has the properties of, for example but not limited to, reducing friction, preventing or retarding corrosion, preventing a bond between concrete and pipe, or other properties. For example, the inner surface 722 and/or outer surface 724 may be coated with TEFLON or other materials.

Figure 42:
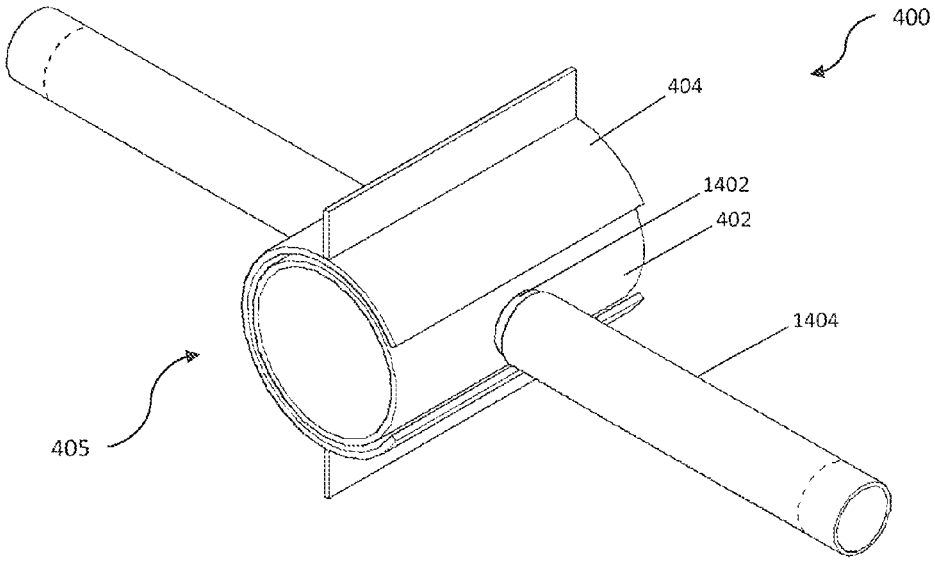
FIG. 42 is a perspective view of an alternative embodiment of load transfer assembly including a single dowel bar.

While FIGS. 6 and 7 provide one variation of an example system, other variations are possible. For example, FIG. 42 illustrates a load transfer assembly 400 with an inner pipe 402, an outer pipe 404, a hinge 405 and a single dowel bar 1402 received on a tube or sleeve of material 1404 such as PVC. In other examples, the pipe sizes of the coupled-type variation shown in FIGS. 4-7 and also the sizes of the dowel ends 116*a*, 116*b* discussed in the variations of FIGS. 11-13 may be chosen from any sizes, for example but not limited to, ANSI (American National Standards Institute) standard sizes. A 0.508 cm to 0.762 cm gap is recommended between the outside radius of inner pipe 402 and inside radius of outer pipe 404 in order to provide enough space for, for example, free rotation in between TEFLON coated surfaces. For 45.72 cm dowel bars: Inner pipe 402: NPS 3-SCH 10 (Nominal Pipe Size: 3, Schedule: 10); Outer pipe 404: NPS ½-SCH 40 (Nominal Pipe Size: 3½, Schedule: 40).

TABLE 1.1

ASTM Standard Construction Pipe Grades (ASTM A53/A53M)

| | Type F | Types E, S | |
|---|---|---|---|
| Property | Grade A | Grade A | Grade B |
| Tensile Strength (psi) | 48000 | 48000 | 60000 |
| Yield Strength (psi) | 30000 | 30000 | 35000 |

Pipes used in the coupled-pipe-type load transfer system 400 may be fabricated using, for example but not limited to, fiber reinforced plastic (FRP) or glass reinforced plastic (GRP) pipes. Glass fiber reinforced thermosetting resin pipe in accordance with ASTM D3517 and ASTM D3262 including: Glass fiber reinforced thermosetting polyester resin mortar; Glass fiber resin reinforced thermosetting polyester resin; Glass fiber reinforced thermosetting epoxy resin mortar; Glass fiber reinforced thermosetting epoxy resin.

Specifications: ASTM D3517-06 Standard Specification for "Fiberglass" (Glass-Fiber-Reinforced Thermosetting-Resin) Pressure Pipe; ASTM D3262-06 Standard Specification for "Fiberglass" (Glass-Fiber-Reinforced Thermosetting-Resin) Sewer Pipe.

Plain steel dowel bars with 40, 50, 60 and 75 steel grades can be used in the construction of load transfer systems described and illustrated herein in FIGS. 4-14. Specifications for ASTM steel bar grades are summarized in Table 1.2.

TABLE 1.2

ASTM Steel Bar Grades

| US Grades | Minimum Yield Strength | Corresponding Metric Grade |
|---|---|---|
| 40 | 40000 psi | 300 |
| 60 | 60000 psi | 420 |
| 75 | 75000 psi | 520 |

Table 1.3 shows different ASTM steel types. It may be preferable to use welding-grade steels, but any material of suitable strength may be used.

TABLE 1.3

ASTM Standard Specifications for Steel Bar Grades (ASTM A615, ASTM A616, ASTM A617, ASTM A706, ASTM A996)

| Steel | | US | | | | Metric | | | |
|---|---|---|---|---|---|---|---|---|---|
| Type | Mark | 40 | 50 | 60 | 75 | 300 | 350 | 420 | 520 |
| Billet | S | A615 | A615 | A615 | A615 | A615 M | A615 M | A615 M | A615 M |
| Low-Alloy | W | — | — | A706 | — | — | — | A706 M | — |
| Rail | I | A616 | A616 | A616 | — | A996 M | A996 M | A996 M | — |
| Rail with Supplementary Requirements | IR | A616 | A616 | A616 | — | — | — | — | — |
| Axle | A | A617 | A617 | A617 | — | A996 M | A996 M | A996 M | — |

The outer pipe 404, FIG. 4 may include one or more ridges 410 that project radially from the spine 405 and longitudinal axis A, which may be vertical ridges. For example, the outer pipe may have a ridge 410 at the top side 406 and a second ridge 410 at the bottom side 408 of the outer pipe 404. The ridges may be made of, for example, but not limited to, steel strips. The ridges 406, 410 in the coupled-pipe-type load transfer system 400 (FIG. 4) extend parallel to the longitudinal axis A of the hinge 405 and may be designed to assist in the proper orientation of the system with the location of the slab joint. More specifically, the spine or elongated hinge 405 and the associated ridges 406, 408 function to help orient the apparatus 400 so as to extend directly perpendicular in the joint between adjacent slabs across the roadway. Any type of cold-rolled or hot-rolled steel strips, for example but not limited to steel strips suitable for welding with edge numbers 1, 2, 3, 4, 5 and 6, can be used in the load transfer system. ASTM specifications for cold-rolled steel strips are presented in Table 1.4.

TABLE 1.4

ASTM Cold-Rolled Carbon Steel Types (ASTM 109/A109M)

| | Temper | Tensile Strength (psi) |
|---|---|---|
| No. 1 | Hard | 90000 ± 10000 |
| No. 2 | Half Hard | 65000 ± 10000 |
| No. 3 | Quarter Hard | 55000 ± 10000 |
| No. 4 | Skin-Rolled | 48000 ± 6000 |
| No. 5 | Dead-Soft | 44000 ± 6000 |

Pipes used in the coupled-pipe-type load transfer system 400 (e.g., FIG. 4) may be fabricated using fiber reinforced plastic (FRP) or glass reinforced plastic (GRP) pipes. Glass fiber reinforced thermosetting resin pipe in accordance with ASTM D3517 and ASTM D3262 including: Glass fiber reinforced thermosetting polyester resin mortar; Glass fiber resin reinforced thermosetting polyester resin; Glass fiber reinforced thermosetting epoxy resin mortar; Glass fiber reinforced thermosetting epoxy resin.

Non metallic materials may be used in the manufacture of the proposed load transfer assembly 400 in accordance with the following specifications: ASTM D3517-06 Standard Specification for "Fiberglass" (Glass-Fiber-Reinforced Thermosetting-Resin) Pressure Pipe; ASTM D3262-06 Standard Specification for "Fiberglass" (Glass-Fiber-Reinforced Thermosetting-Resin) Sewer Pipe.

Columbium—Vanadium steel strips may also be used in coupled dowel bar system (e.g., FIG. 4). For example, but not limited to, Columbium-Vanadium steel grades 42, 50, 55, 60 and 65 according to ASTM A572/A572M.

Where the dowel bars 116 are made of fiber reinforced plastic or glass fiber reinforced plastic, the strips may be made simultaneously with the pipes or be made separately and later attached to the outside pipe.

Figure 10:
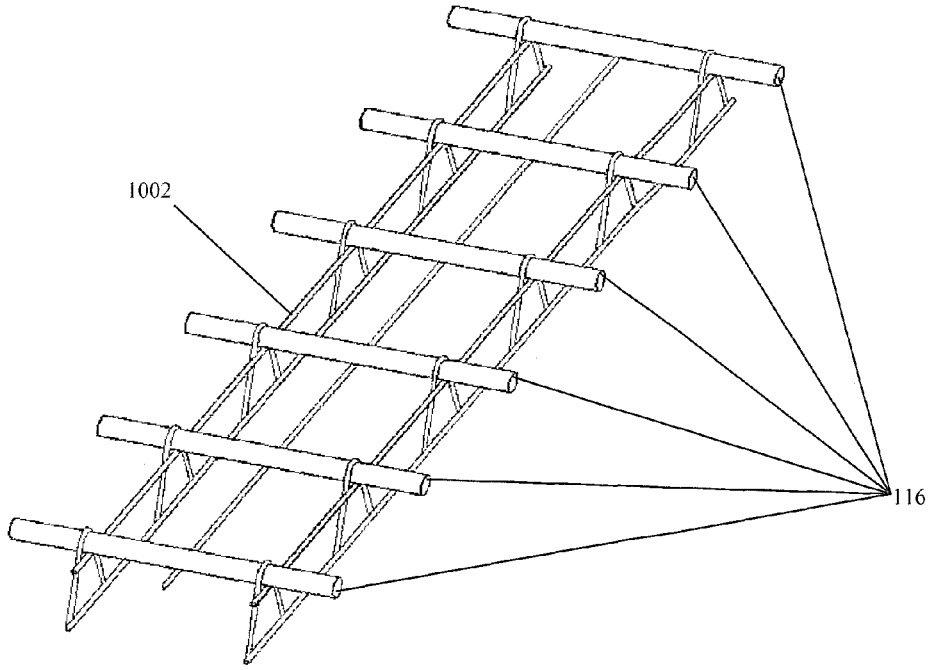
(PRIOR ART) FIG. 10
FIG. 10 is a perspective view illustrating a bolster of the prior art which prevents hinged movement of any dowel bars.

Similar to the current state of practice, steel or plastic baskets or bolsters 500 may be fabricated for hinged dowels in order to facilitate their placement in the pavement during a new construction project or a retrofit. Two possible configurations for hinged dowel bar load transfer system baskets or bolsters 500 are shown in FIGS. 8 through 9. Placement baskets or bolsters 500 should be strong enough to keep the hinged dowel bar load transfer system 400 in the designed positions during the fresh concrete pour. However, the support basket or bolster 500 must not be too stiff as to inhibit free rotation of the load transfer assembly system 400. This rotation may be facilitated by a support bolster 500 which offers a soft cushion at the point where the dowel rests on it. FIG. 10 demonstrates the current state of practice in dowel bar technology. As FIG. 10 demonstrates, state-of-the-art bolsters do not permit free rotation at the joints.

In any of the variations of the hinged dowel bar load transfer system 400, the dowel bars 116 may be fabricated using bars with circular, rectangular, or elliptical cross sections.

Figure 11A:
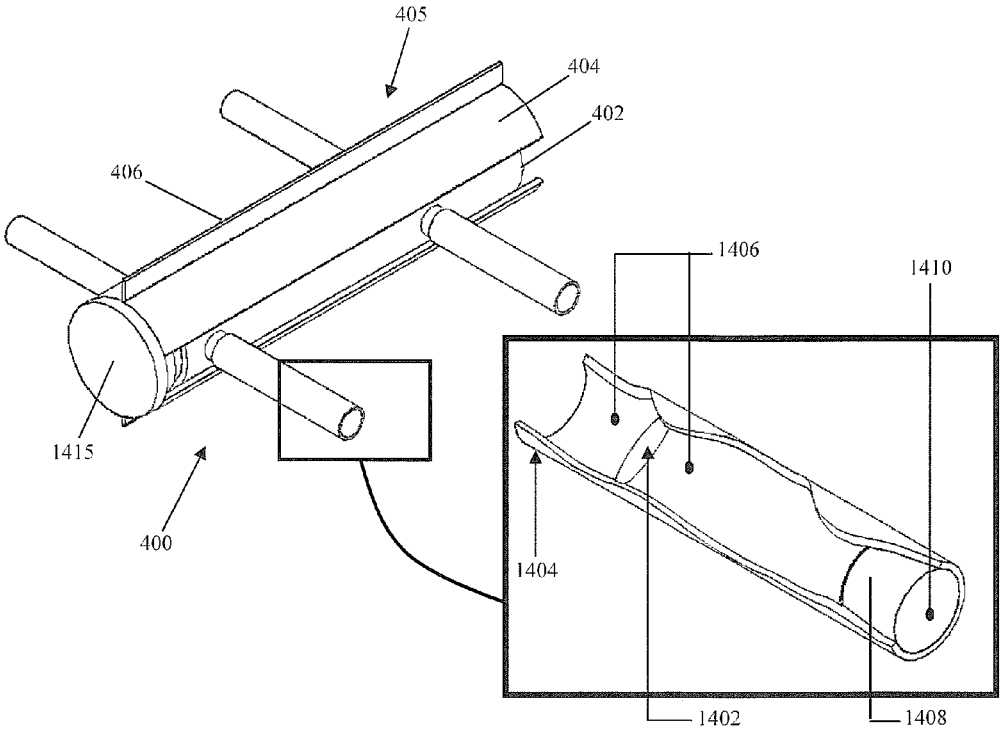
FIGS. 11A-11C are respective perspective, top plan and side elevational views of one possible embodiment of the apparatus.
Figure 11B:
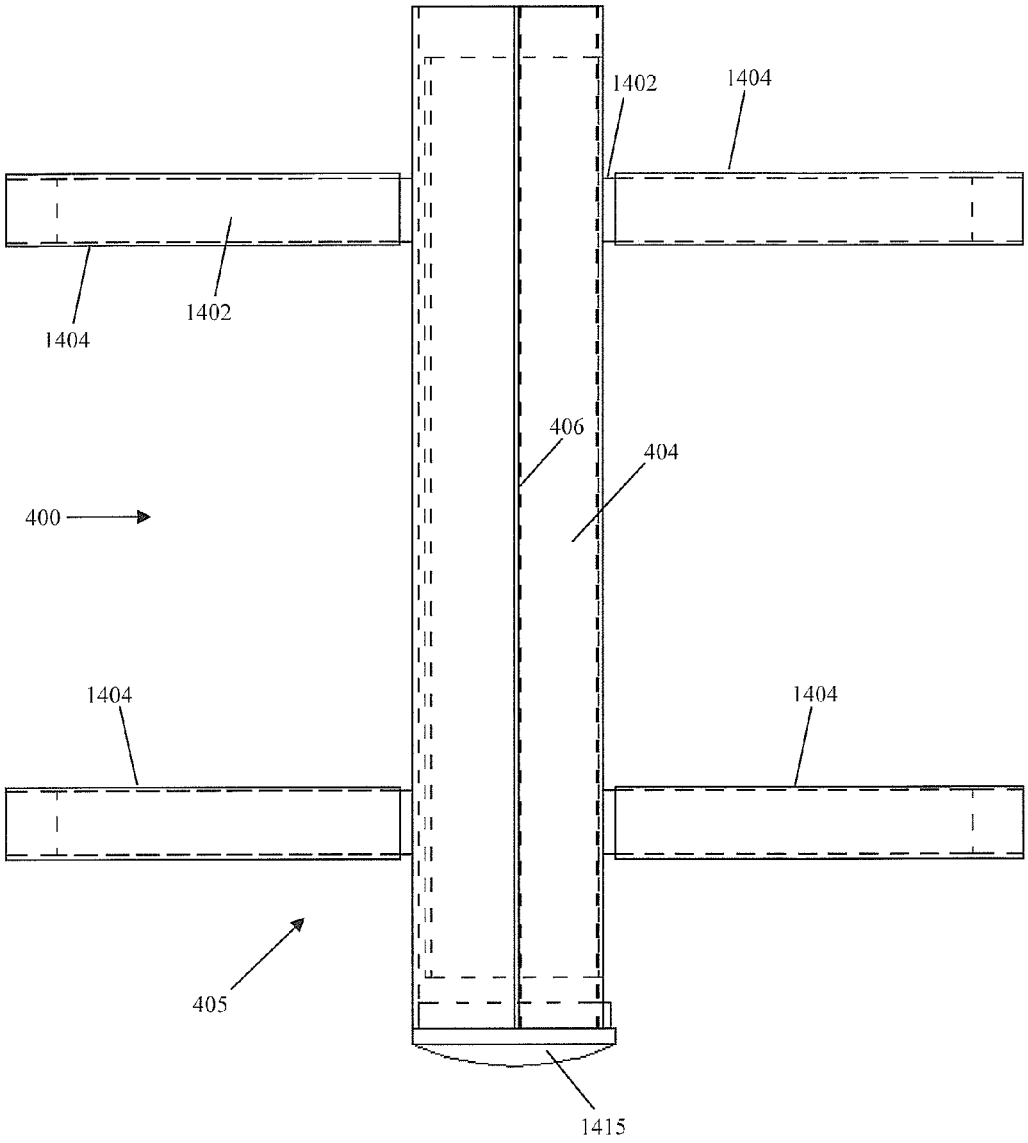
Figure 11C:
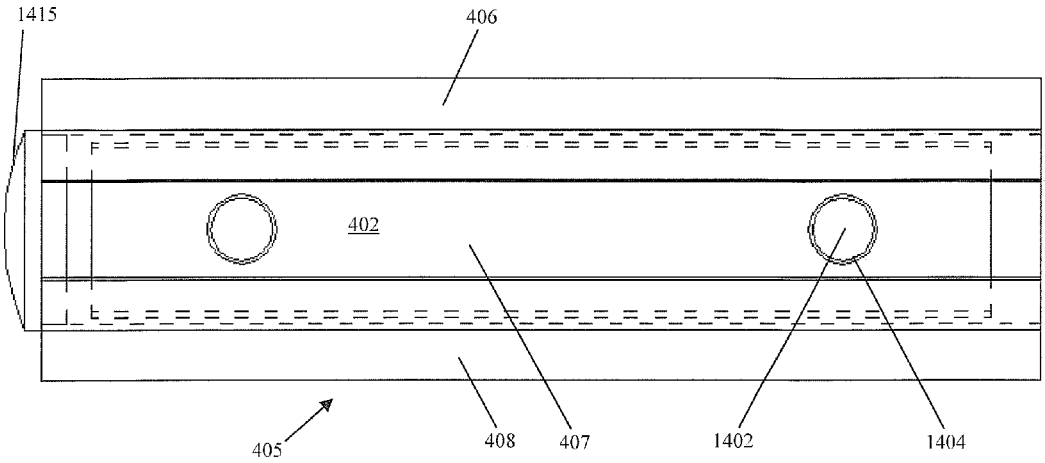

Expansion and contraction of concrete slabs can apply large forces in rigid pavements and cause serious stress, for example, at slab joints. To provide pavement slabs with, for example, freedom for expansion and/or contraction, concrete pavements may be designed so that dowel bars are anchored in one slab and yet slide freely inside the adjacent slab. However, in the hinged load transfer assembly, as illustrated in FIGS. 11A-11C as well as other variations, free slip tubing may be used to, among other things, minimize the friction, and assure a free slip condition on both sides of the hinged dowel bar load transfer system. Except for the rotatable portion of the load transfer assembly, each dowel bar would be TEFLON coated and embedded in a polymer tube or sleeve in order to ensure free horizontal movement inside the concrete slab. To illustrate, a dowel bar 1402 may be placed in a tube or sleeve of material 1404 such as PVC. The contact area 1406 between dowel bar 1402 and tube 1404 may be uncoated or may be coated with a layer of material with properties such as friction reduction or otherwise, for example, TEFLON. A plastic cap 1408, which may be soft plastic cap, may be placed at the tip 1410 of the tube 1404. This cap 1408 is designed to create a gap between freshly poured concrete and the tip of the dowel bar 1402 and a concrete slab. This cap 1408 would permit movement due to thermal expansion by serving as a buffer zone between the tip of the dowel bar and the concrete. The cap 1408 must fit tightly inside the tube 1404, which in turn must fit the dowel bar 1402, with nominal diameter, among other dimensions, 3.175 cm.

Figure 12:
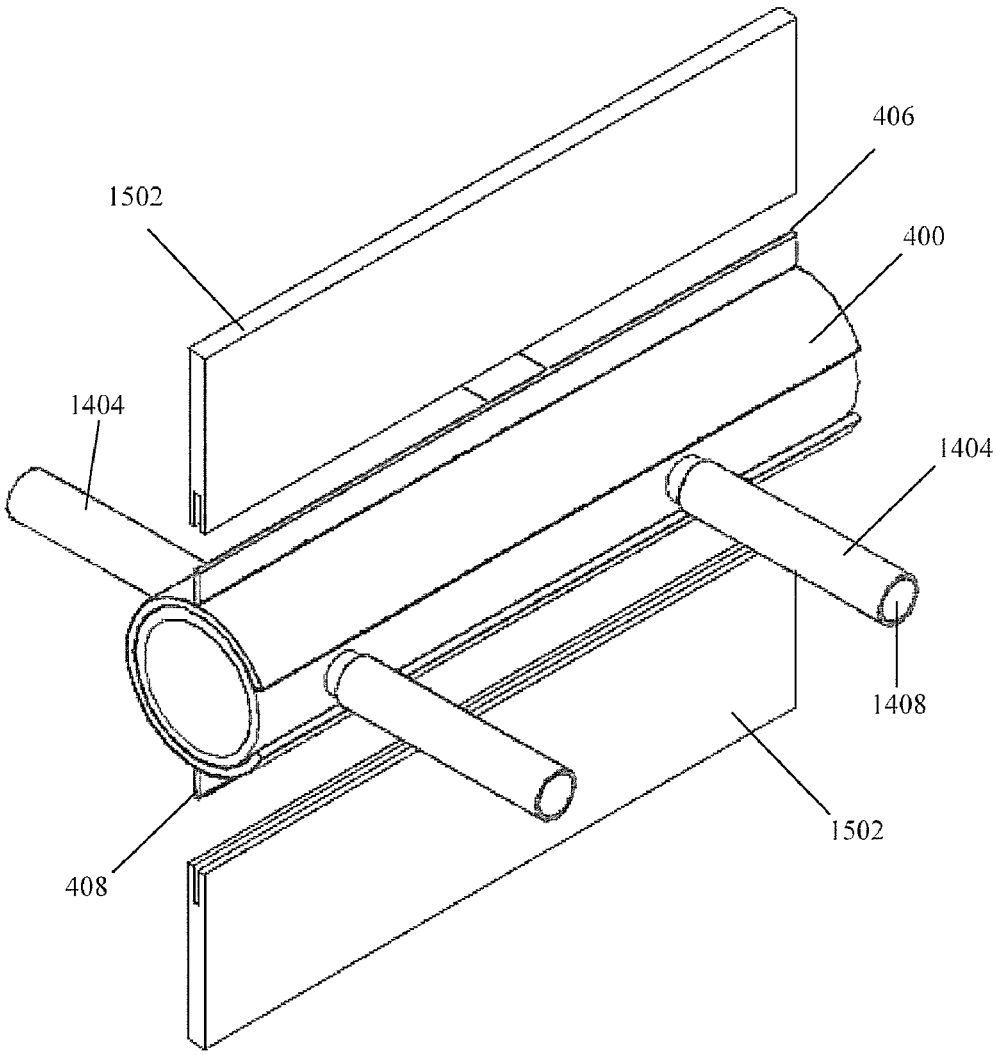
FIG. 12 is a detailed perspective view of spacers connected to the ridges of the load transfer assembly.

Referring to FIG. 12, in another variation, a load transfer assembly may include a spacer 1502, which may be a flexible spacer or may be a compressible spacer. The spacer 1502 may be removably or permanently connected to a ridge 406. For example, in a couple-pipe-type FIG. 4, 400 load transfer system, the spacer 1502 may be connected to at least one of the upper ridge 406 and the lower ridge 408 of the an outer pipe 404. The spacer 1502 may be attached to the ridge 406 by groove and slot engagement. The spacer 1502 may provide a joint space of approximately 1.27 cm between slabs 102. The spacer 1502, may be made of, for example but not limited to, flexible polymer. The spacer 1502, may provide a flexible rotation spacer to facilitate slab 102 rotation at a joint 112.

The following is a non-exhaustive list of materials that may be used to manufacture the joint spacer. These materials are identified below by their modulus of elasticity, E, in pounds per square inch (psi): Toughened Nylon 6, E=290 000 psi as molded; E=102 000 psi conditioned in 50% relative humidity; Allyl Diglycol Carbonate Cast Sheet, E=300 000 psi; Polyimide, Thermoplastic, E=300 000 to 400 000 psi; Acrylics, Cast Sheet, E=310 000 to 3 100 000 psi; Polyphenylene Oxide (PPO) (PPE) modified with polystyrene, E=310 000 to 380 000 psi; Chlorinated PVC (CPVC), E=326 000 to 475 000 psi; Polystyrene (PS), E=330 000 to 475 000 psi; Polyvinyl Chloride (PVC) Rigid, E=350 000 to 600 000 psi; Acetal Copolymer, E=377 000 to 464 000 psi; Polyethersulfone, E=385 000 psi; Polyester (PET), E=400 000 to 600 000 psi; Phenolic Unfilled, E=400 000 to 700 000 psi; Vulcanized Rubber, E=400 000 psi; Polyetherimide, E=430 000 psi; Styrene-Acrylonitrile Copolymer (SAN), E=475 000 to 560 000 psi; Polyphenylene Sulfide (PPS), E=480 000 psi; Polyamide Nylon 6 Cast, E=485 000 to 550 000 psi; Polyacrylonitrile (PAN) Extrusion Grade, E=500 000 to 550 000 psi; Polyaryletherketone, E=520 000 to 580 000 psi; Polyketone, E=520 000 psi.

Figure 13:
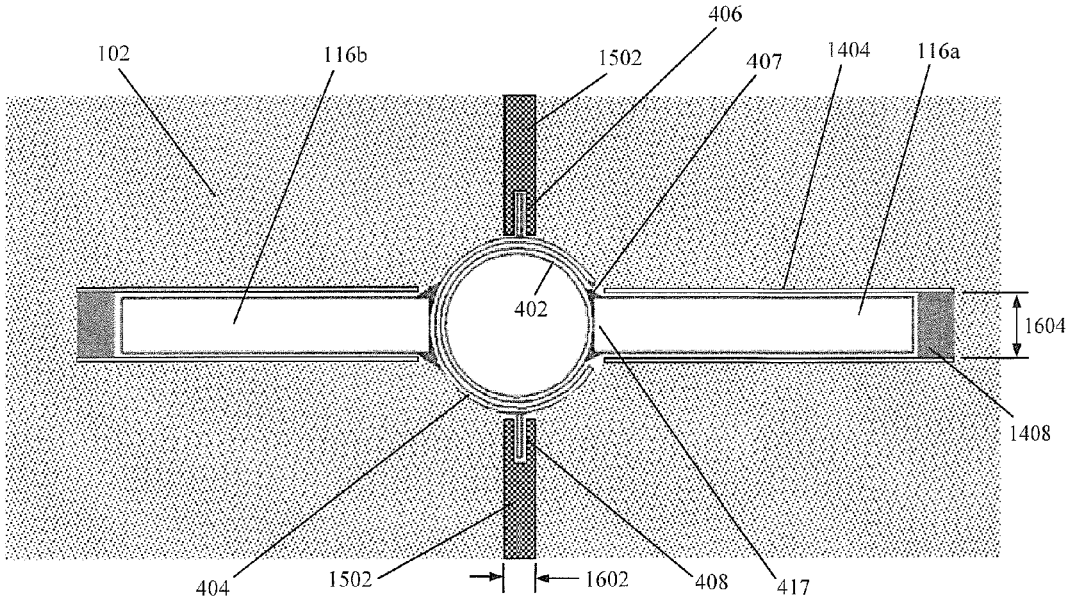
FIG. 13 is an end view showing the load transfer assembly of FIG. 12 between two concrete slabs.

FIG. 13 illustrates how the spacer 1502 may be fitted to the top ridge 406 and bottom ridge 408.

FIGS. 8A-8D illustrate the step-by-step use of the load transfer apparatus 400 in original road construction. Initially, stakes or pins (not shown) are installed beyond the outer edges E of the future concrete slabs and a string is tied between the stakes so that the string run along the future joint J (see FIG. 8A). Next, the bolsters 500 are placed in alignment under the sting along the future joint line J (see FIG. 8B). The bolsters 500 include soft filler spacers in the depressed area of support where the dowel bars 116 will rest.

A soft filler 417 (see FIG. 13) is placed in the slot 407 of the outer pipe 404 so as to fill the area of the slot between the dowel bar ends 116*a*. The soft filler may be pieces of weather stripping held in place with contact glue or a suitable substitute. The filler pieces 417 assist in keeping fresh concrete from entering the hinge 405 in the joint between the inner and outer pipes 402, 402. Next, the apparatus 400 is positioned on the bolsters 500 in alignment with the future joint J (see FIG. 8C). The stakes and string are removed and the concrete slabs S are joined in accordance with specified procedures (see FIG. 8D).

FIGS. 9A-9F illustrate the step-by-step use of the load transfer apparatus 400 in maintenance repair of a roadway. First, the deteriorated area of the roadway requiring replacement is saw cut and removed (see FIG. 9A). Typically, saw cuts are made at least 45.72 cm beyond any concrete deterioration or cracking. Next, horizontal holes H are located and drilled in exposed faces F of remaining roadway R. The saw cuts that form the faces F are perpendicular to the roadway R and the holes are perpendicular to the faces F (see also FIG. 9B). This helps to insure proper alignment of the load transfer apparatus 400 for best stress relief.

Next, epoxy or other suitable substitute adhesive is applied to the outer surface of the sleeves and the sleeves are immediately installed in the drilled holes H hinge. The bolsters 500 are then properly aligned with the future joint by means of a string extending between stakes (not shown) beyond each edge E of the roadway R (see FIG. 9C). If not already installed, bar ends 116*b* and filler 417 are installed in the outer pipe 404 and the outer pipe is positioned on the bolsters 500 in alignment with the future joint. The support frames or bolsters 500 are of the same length as the bar ends 116*b* (see FIG. 9D). A similar installation as described above is then completed in the face F of the opposite remaining roadway section R (see FIG. 9E). Finally, the stakes and strings are removed and the concrete for the repair patch P is poured and allowed to cure according to construction specifications (see FIG. 9F).

EXPERIMENTS

The following experiments are presented only for further description and understanding of the load transfer system. The experiments are not meant to limit the invention, rather they are merely illustrative.

Finite element computer modeling was employed to analyze the effect of using the disclosed variations of a load transfer system on rigid pavements, and to quantify any potential benefits. These analyses showed that the load transfer system reduces shear stresses in concrete pavements by approximately 15%-20%. This is a major benefit to the longevity of concrete pavements. The details of finite element modeling, including dimensions, loading conditions, material properties, etc., are described below.

Figure 14:
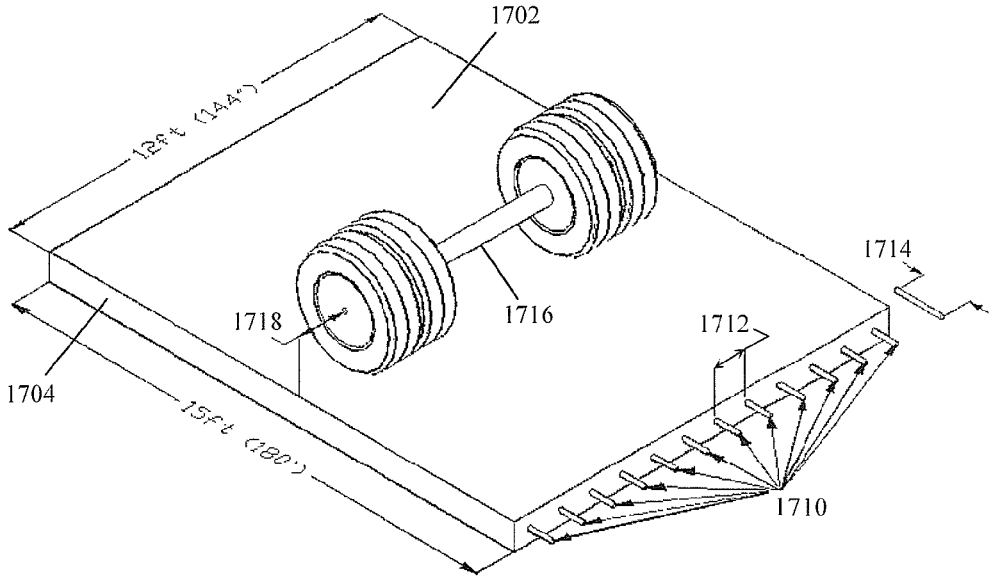
FIGS. 14-16 schematically illustrate different concrete slab loading scenarios.

Finite Element Model—For this example and experiment, the dimensions and material properties for concrete slabs are shown in FIG. 14: Concrete Slab 1702 Dimensions: 457.2 cm×365.76 cm×25.4 cm; Concrete Density 1704: 0.8670 lb/in$^3$; Concrete Elasticity Modulus: $4\times10^6$ psi; and FIG. 16: Slab Joint Opening 1904: 1.27 cm.

Dimensions and material properties for dowel bars: Dowel Bar Dimensions 1708: Section Diameter 1710=3.175 cm; Nominal center-to-center distance between dowel bars 1712, among other dimensions, is 30.48 cm; Nominal dowel bar length 1714, among other dimensions, is 45.72 cm. Choices of materials: Steel Modulus of Elasticity: $29\times10^6$ psi; Polymer Modulus of Elasticity: $5.92\times10^6$ psi.

Axle 1716 properties: Average Traffic Wander Data 1718: 45.72 cm; Axle Width: 2.59 m; Axle Type: Single Axle with Dual Tires Variations in the finite element model: Loading Positions: Middle Slab FIG. 15, 1802; Joint Edge FIG. 18, 1804; Over-Joint, FIG. 16, 1902.

Axle 1716 Loads: 10 Kip, 18 kip, 32 kip; Subgrade California Bearing Ratio, CBR: 2%, 4%, and 8%. The higher CBR number refers to a stronger pavement foundation soil.

Three different traffic tire loading positions were used in the finite element analysis in order to evaluate the impact on the maximum shear stress in the concrete pavement. These tire locations were: Middle Slab FIG. 15, 1802, Joint Edge FIG. 15, 1804, Over-Joint, FIG. 16, 1902. A single axle with dual tire is used for all the loading scenarios so that the resulting stresses may be compared to each other in the post-calculation analysis.

Figure 15:
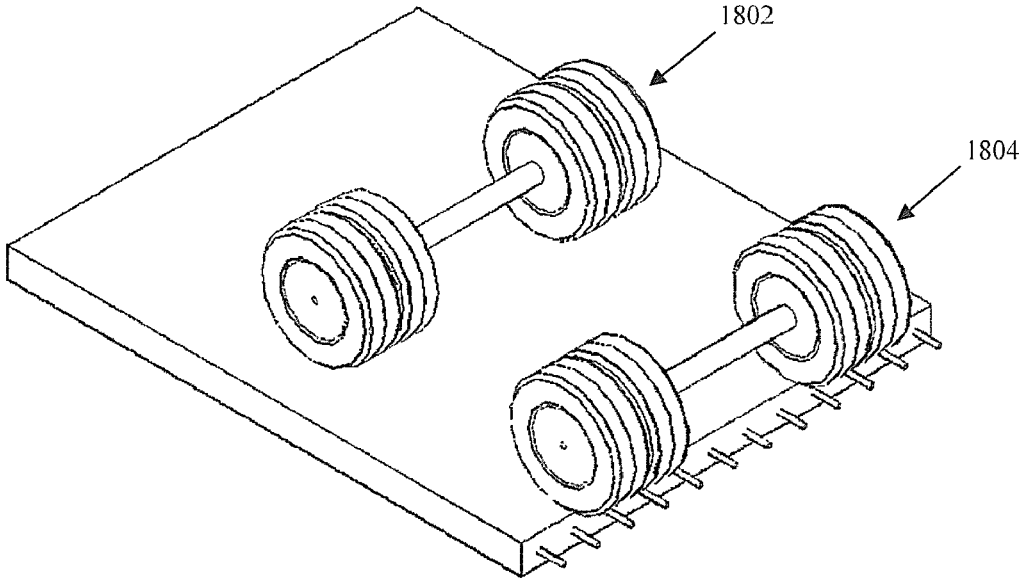
Figure 16:
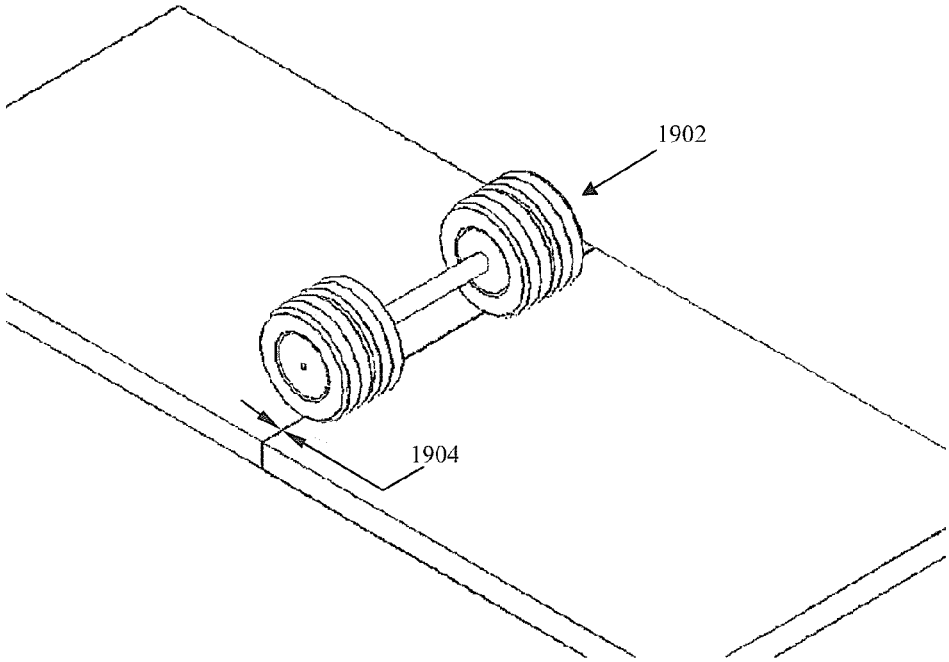
Figure 17:
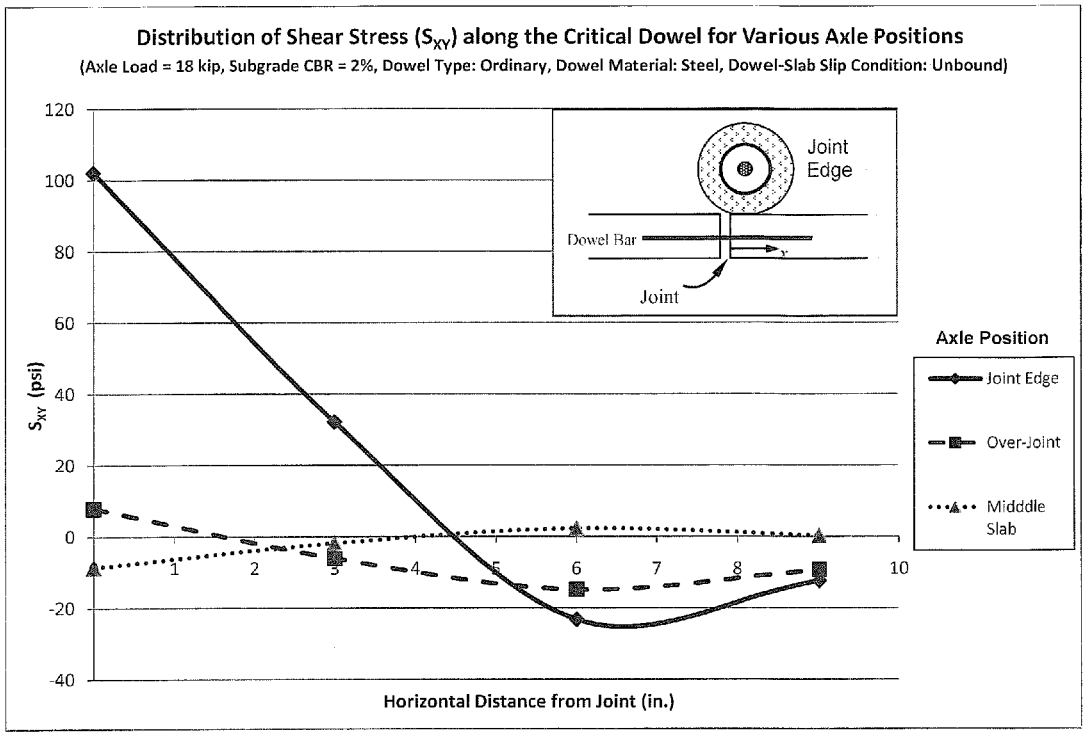
FIGS. 17 and 18 are graphs of shear stress ($S_{xy}$) versus horizontal distance from joint.

As shown in FIG. 17, the disclosed load transfer system affects the maximum Shear stress in a slab when the axle is on the Joint Edge FIG. 15, 1804 or Over-Joint, FIG. 16, 1902. Since shear stress ($S_{XY}$) reaches its maximum when the wheels are exactly at the Joint Edge FIG. 15, 1804, the reduction in shear stress in this case can be of great importance to pavement longevity. When the disclosed load transfer system is not used, traffic loads produce high shear stresses in the concrete slab, which lead to shear cracks in concrete near the dowel bar. These shear cracks propagate to the larger slab causing premature degradation requiring expensive repair. Eventually, damage such as but not limited to, shear cracks result in pavement degradation such as concrete breaking into pieces near the slab joints, and will lead to costly repair.

Full Stress Analysis

The results of a full stress analysis study are presented below. This study demonstrates that the proposed load transfer system is superior to the current practice of using traditional dowel bars that are incapable of rotating around an axis. That is, the dowel bars of the disclosed load transfer system function at a lower shear stress, which translates into a longer longevity for the concrete pavement.

In this example, the performance of the disclosed load transfer system is also compared to Fiber Reinforced Plastics (FRP) dowel bars. In order to evaluate the behavior of rigid pavements with the load transfer systems, the response of various parts of the pavement were also analyzed and presented in below.

Figure 19:
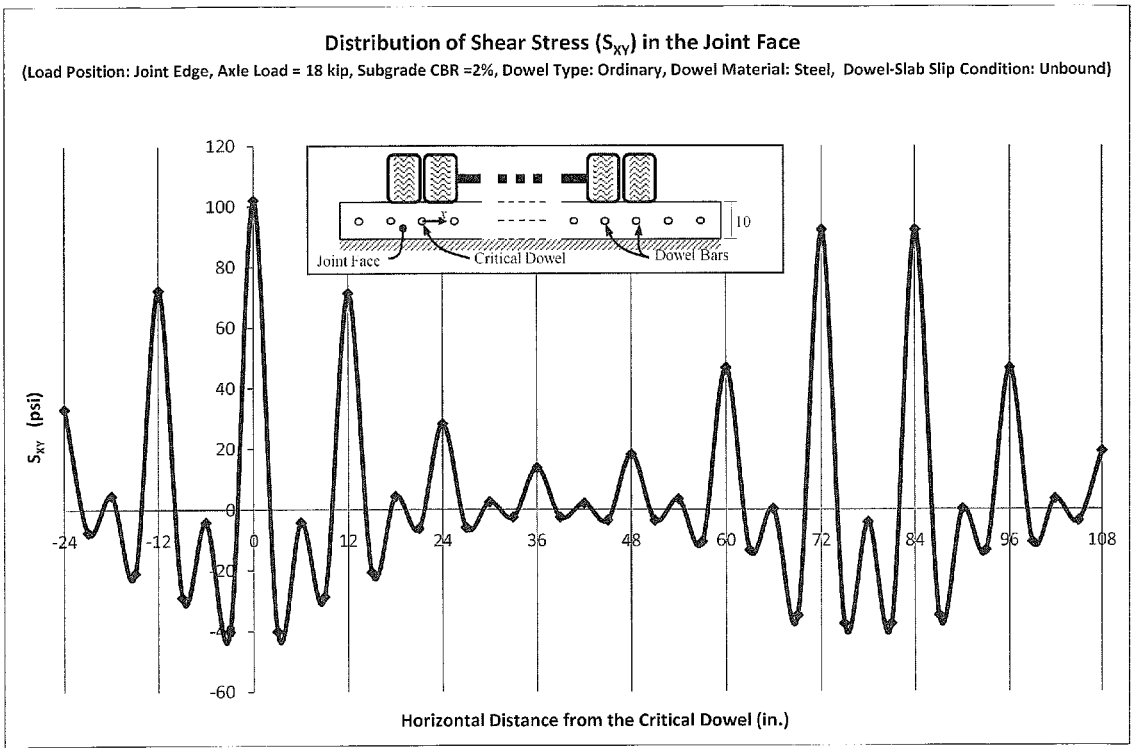
FIG. 19 is a graph of shear stress ($S_{xy}$) versus horizontal distance from the critical dowel.

Detailed Analysis Results: Three different loading positions were used in the finite element model (Middle Slab FIG. 15, 1802; Joint Edge FIG. 15, 1804; Over-Joint, FIG. 16, 1902) to evaluate the effect of loading position on the maximum shear stress in the concrete slab. As demonstrated in FIG. 17, when the axle load was placed at the Joint Edge FIG. 15, 1804, the shear stress along the critical dowel was significantly higher than when the load was placed Over-Joint, FIG. 16, 1902, or Middle Slab FIG. 15, 1802. The critical dowel bar is located exactly beneath the middle line of a dual tire wheel width (as shown in FIG. 19), and it imposes the highest stress on concrete. In fact, when the axle was placed exactly Over-Joint 1706, FIG. 16, the axle load 1902 was equally divided between two slabs.

Figure 18:
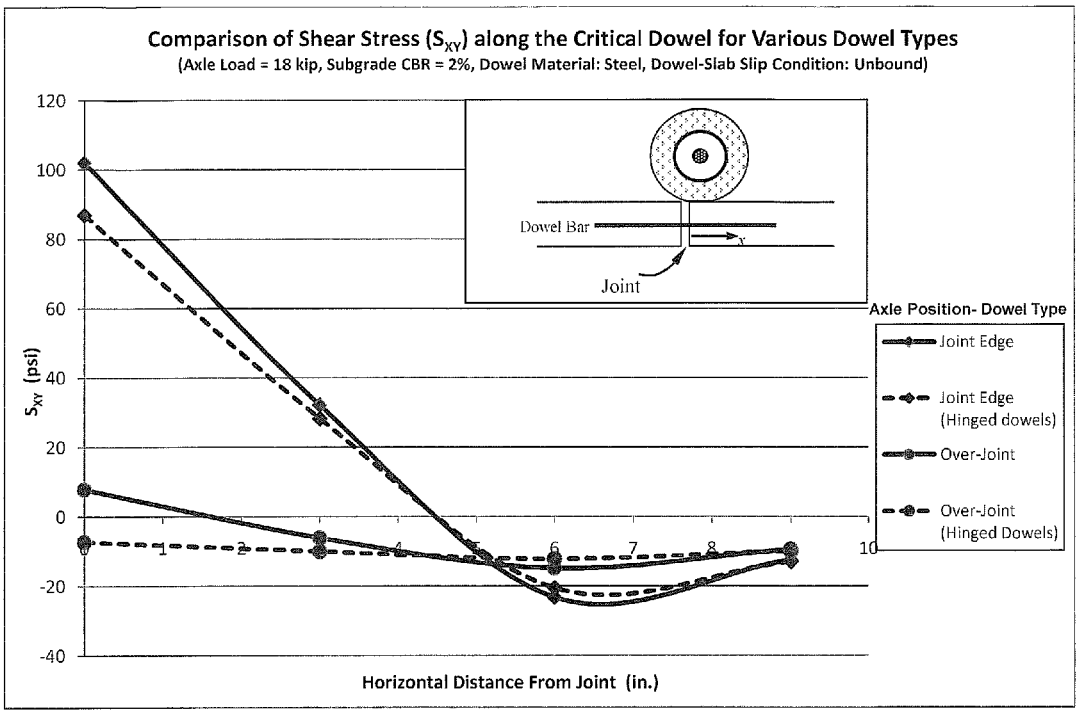

The shear stress along the critical dowel bar, as shown in FIG. 19, for an 18-kip axle load is shown in FIG. 18, where the origin of the horizontal axis is assumed to be placed at the mid length of the critical dowel bar. According to the FIG. 18, the benefit of the load transfer system is more pronounced when the axle was on the Joint Edge FIG. 15, 1804 (the most severe case of loading in concrete pavement).

Figure 20:
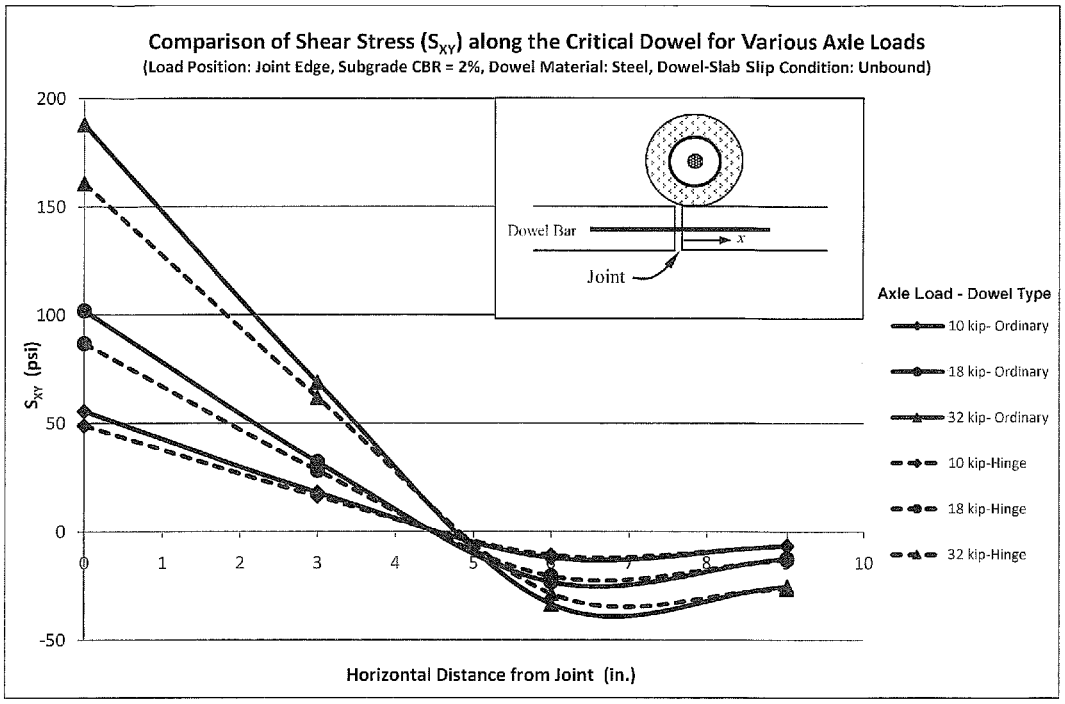
FIGS. 20 and 21 are graphs of shear stress ($S_{xy}$) versus horizontal distance from joint.

The benefit of using the disclosed load transfer system is further supported by the data presented in FIG. 20. Using the load transfer system decreases the shear stress ($S_{XY}$) in the concrete slab. For a weak subgrade (CBR=2%), when an 18-kip axle with 125 psi tire pressure was placed at the edge of the slab, using the load transfer system caused a 15%-20% reduction in maximum shear stress ($S_{XY}$). Similarly, when the axle load was increased to 32-kip with tire pressure of 111 psi, the maximum shear stress was reduced 15%-20% as a result of using the load transfer system.

Figure 21:
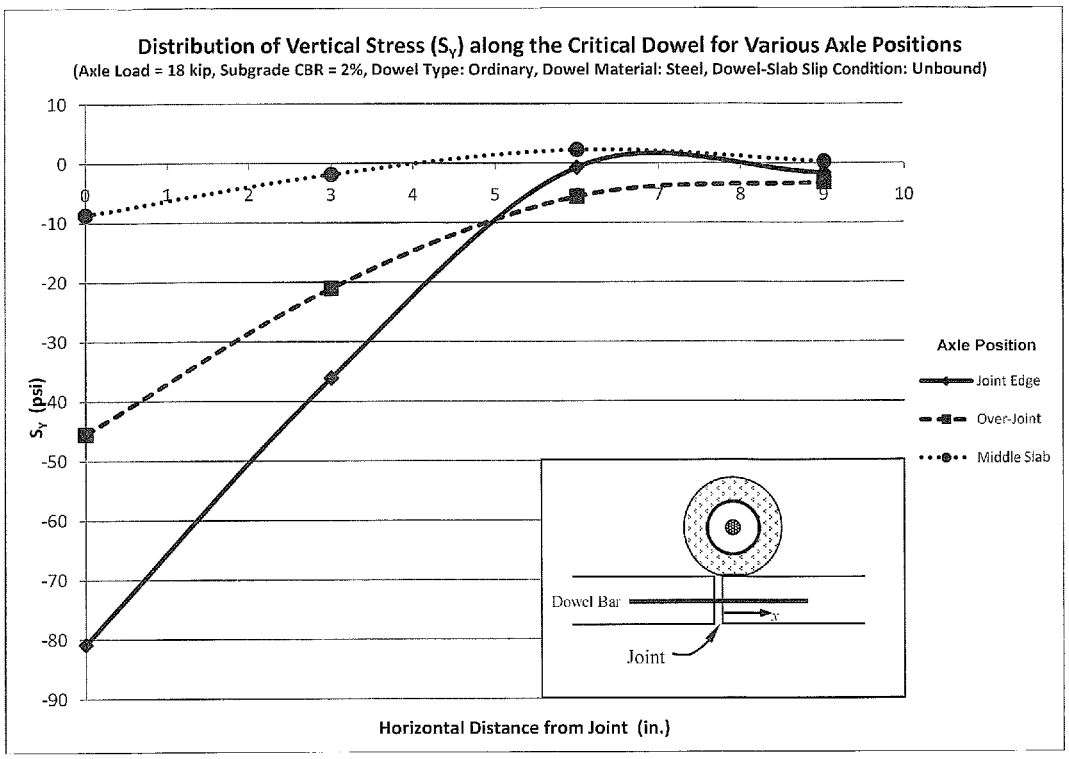

The concrete normal (vertical) compressive stress along the length of the critical dowel bar is presented in FIG. 21. Because of the relatively high elasticity modulus of concrete, the slab deformation was very small and most of the vertical stress was distributed right under the loading area. However, the vertical stresses, as shown in FIG. 21, fell below the compressive strength of most concrete pavements.

The variation of shear stress ($S_{XY}$) in the joint face is illustrated in FIG. 21 for a single 18-kip axle load placed at the joint edge. The horizontal axis is assumed to be on the centerline of the joint face, and every vertical line in FIG. 21 represents centerline of a dowel bar. The critical dowel bar is right beneath the centerline of the dual wheels. The FIG. 21 also demonstrates that the load on one side of the axle did not affect the stress distribution on the other side. Therefore, each side of the axle may be modeled separately.

Figure 22:
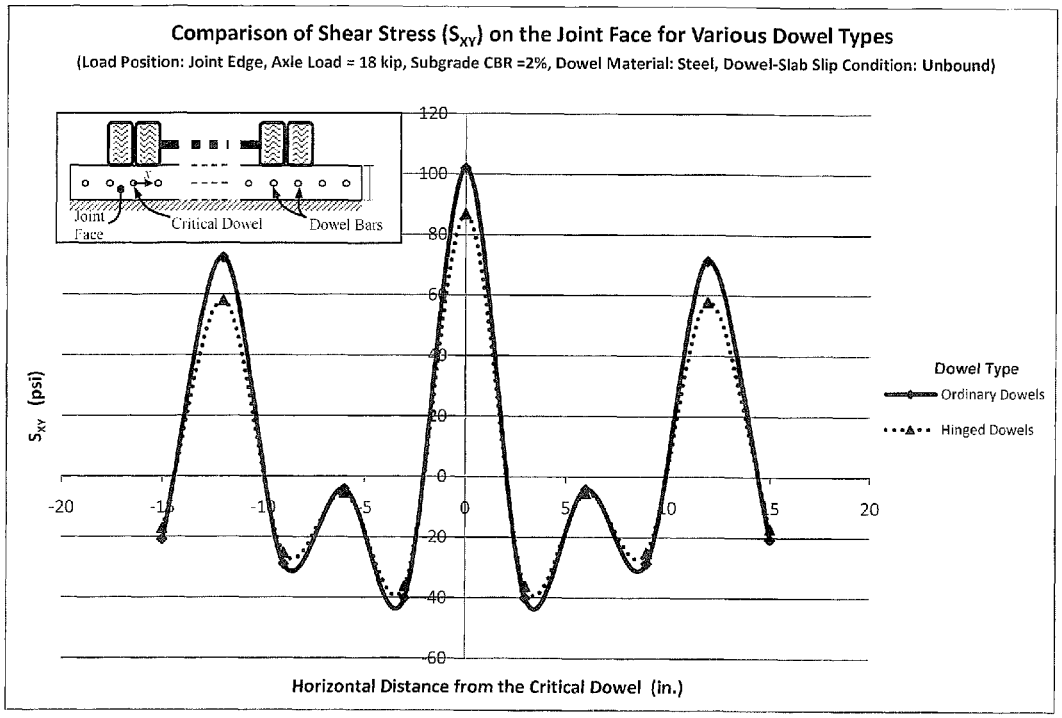
FIGS. 22-24 are graphs of shear stress ($S_{xy}$) versus horizontal distance from the critical dowel.

The Effect on shear stress in the joint face and around the critical dowel bar is illustrated in FIG. 22. The shear stress ($S_{XY}$) in the joint face and along the centerline (where dowel bars are placed) decreases. This reduction can prolong the slab service life. The decrease in shear stress ($S_{XY}$) would be larger for heavier axles.

Figure 23:
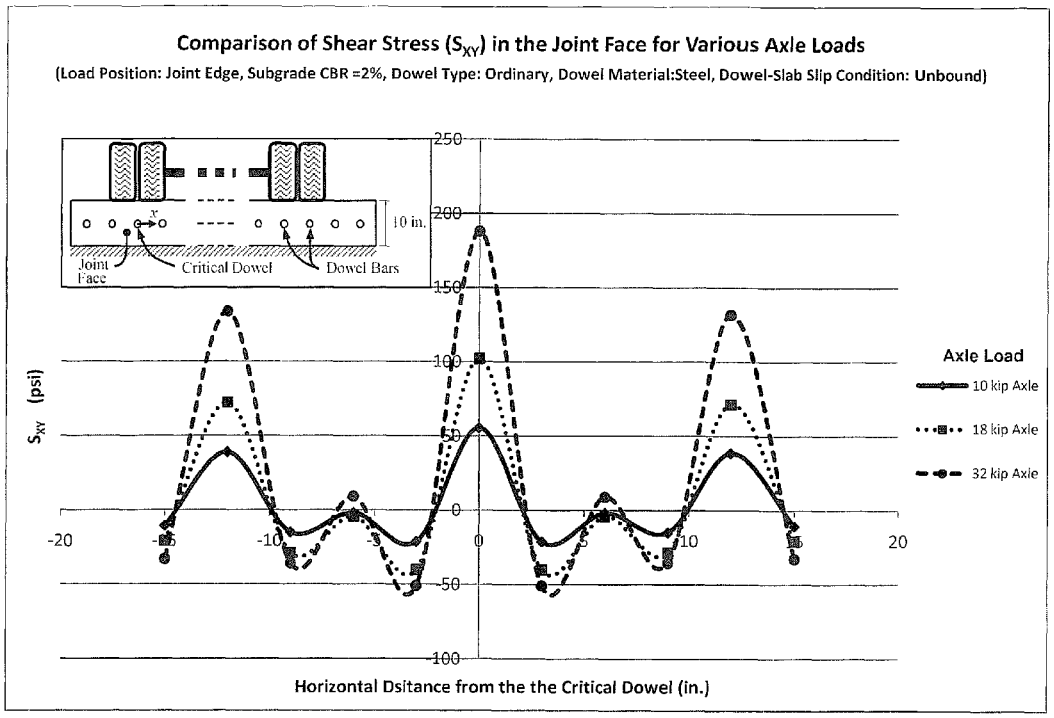

The shear stress ($S_{XY}$) in the plane of joint is plotted in FIG. 23, for three different axle loads, and for a joint with ordinary dowel bars. Although the shear stress variation keeps its overall pattern, the axle load has a remarkable effect on shear stress magnitude. In fact, the efficiency and durability of the joint load transfer system is highly related to the axle loads.

Figure 24:
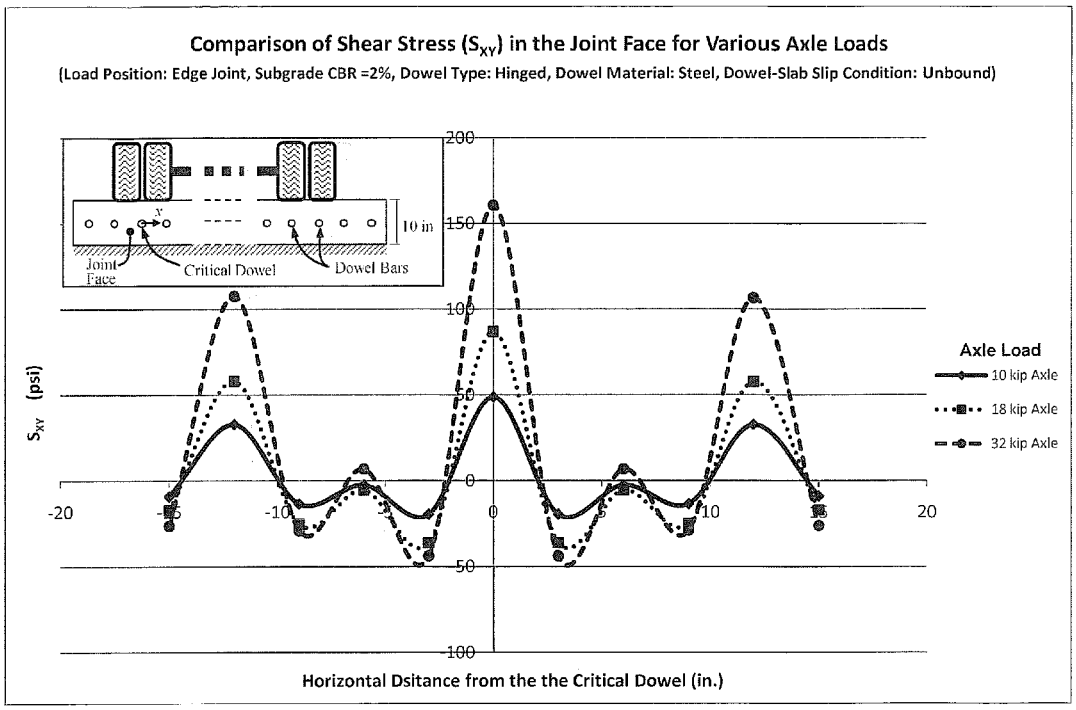

The shear stress in the joint face is depicted in FIG. 24. The shear stress ($S_{XY}$) in the joint face and around the critical dowel bar (where shear stress reaches its maximum) increases by increasing the axle load. A comparison between FIG. 23 and FIG. 24 reveals the effect of using the disclosed load transfer system on shear stress ($S_{XY}$) for different axle loads. The shear stress ($S_{XY}$) decreased by 15 to 20 percent over traditional systems.

Figure 25:
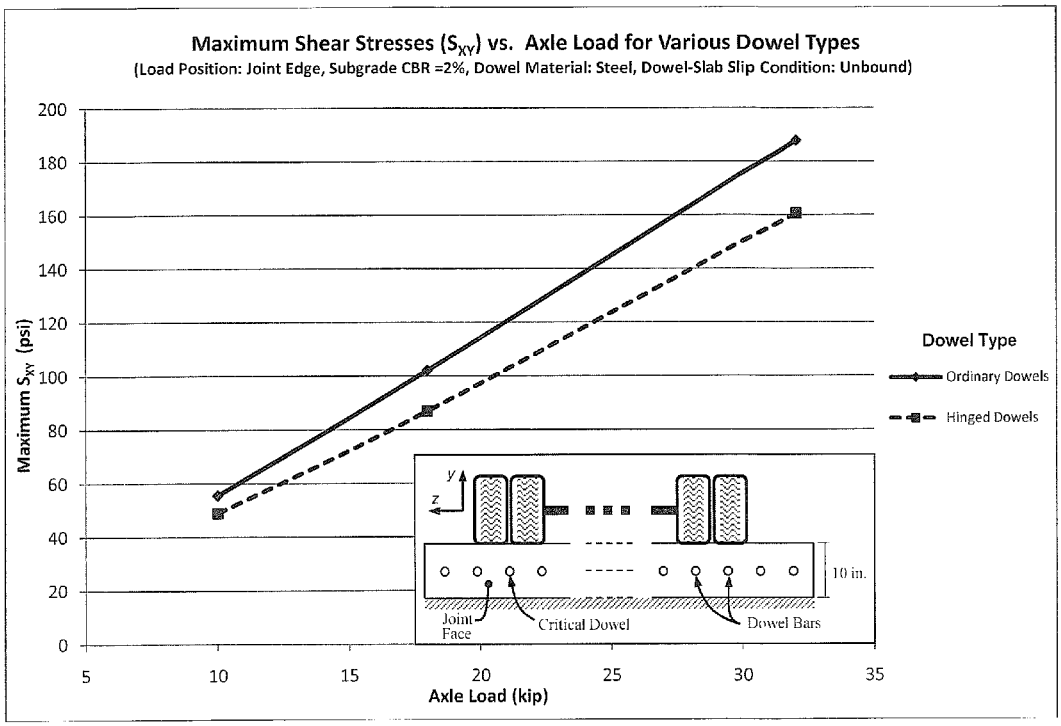
FIG. 25 is a graph of maximum shear stress ($S_{xy}$) versus axle load.

The effect of axle load on maximum shear stress in the joint face is depicted in FIG. 25. The maximum shear stress ($S_{XY}$) increased linearly with the increase in axle load. Regarding the slope of the lines in FIG. 25, the critical shear stress was remarkably sensitive to the axle load and overloaded trucks drastically increase the shear stress. The positive effect of the disclosed load transfer system in reducing the shear stress can also be seen in FIG. 28. The disclosed load transfer systems alleviate the shear stress level while maintaining efficient load transfer between slabs.

Figure 26:
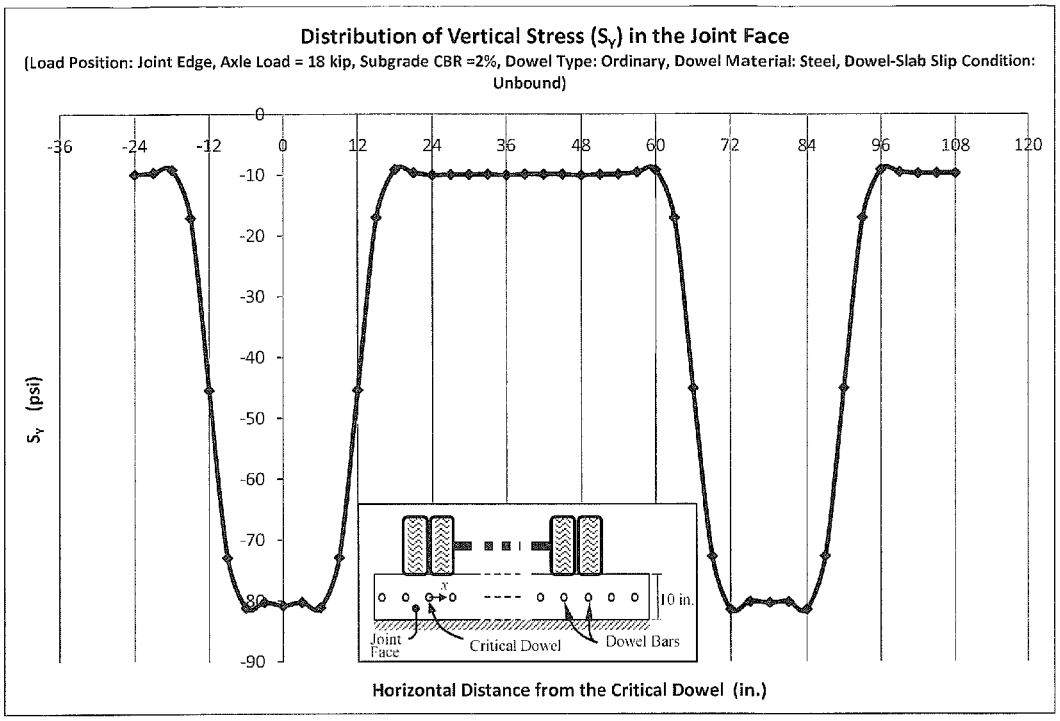
FIGS. 26 and 27 are graphs of compressive stress in vertical direction ($S_y$) versus horizontal distance from critical dowel.

Variation of normal compressive stress in vertical direction is shown in FIG. 26. The vertical lines in FIG. 26 show the dowel bar locations. As it can be seen in this figure, the vertical $S_Y$ stress in the joint face is much smaller than concrete compressive strength, which is normally 2 000 to 4 000 psi, and is not likely to cause any failure.

Figure 27:
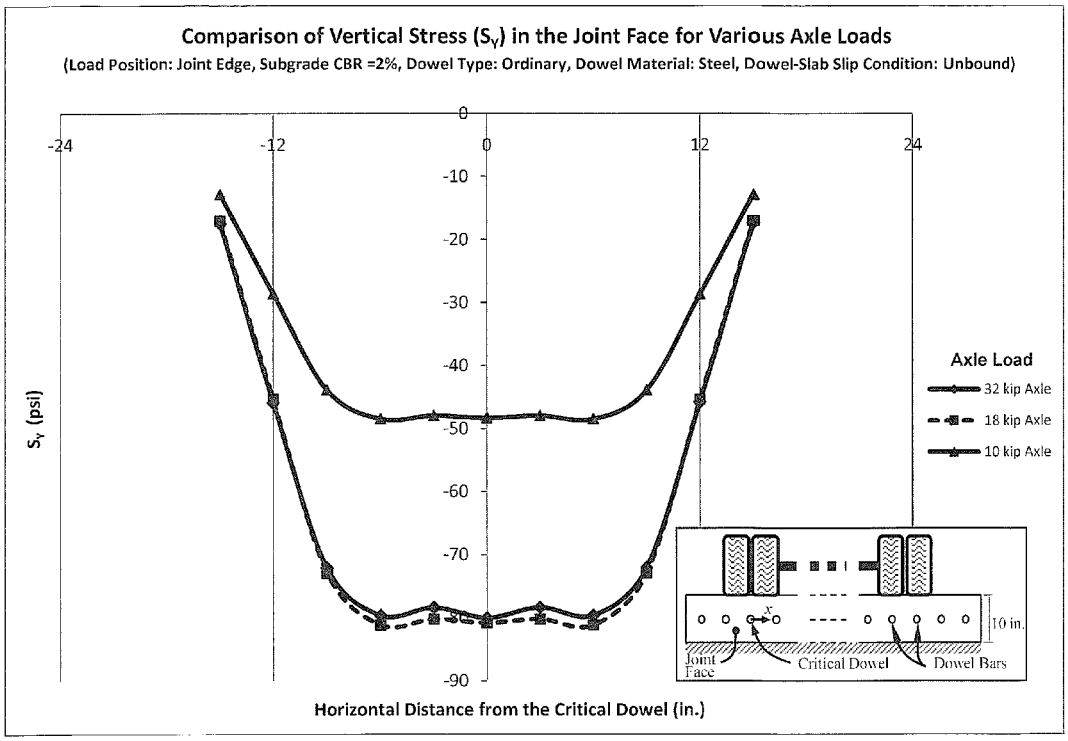

FIG. 27 shows the vertical compressive stress in the concrete slab and around the critical dowel bar for different axle loadings. The reason for similarity between 18-kip and 32-kip axle curves is the adjusted tire loading contact areas in the finite element model. In the model with 32-kip axle, the tire loading contact area was increased to maintain the same tire pressure as the 18-kip axle.

Figure 28:
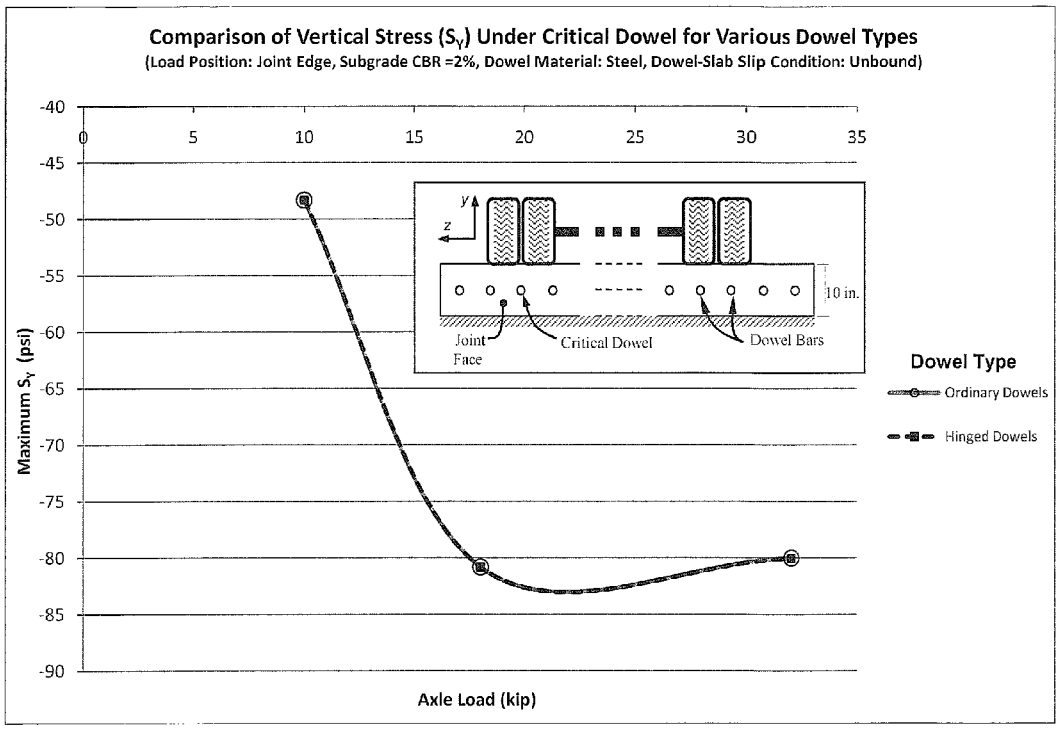
FIG. 28 is a graph of vertical compressive stress ($S_Y$) versus axle load.

In order to evaluate the vertical compressive stress ($S_Y$), maximum $S_Y$ was plotted in FIG. 28 for different axle loads. The plot in FIG. 28 was provided as a check to ensure that the vertical stresses in a disclosed load transfer system do not exceed those of ordinary dowels. As can be seen, vertical compressive stress ($S_Y$) does not change as a result of using the disclosed load transfer system.

Figure 29:
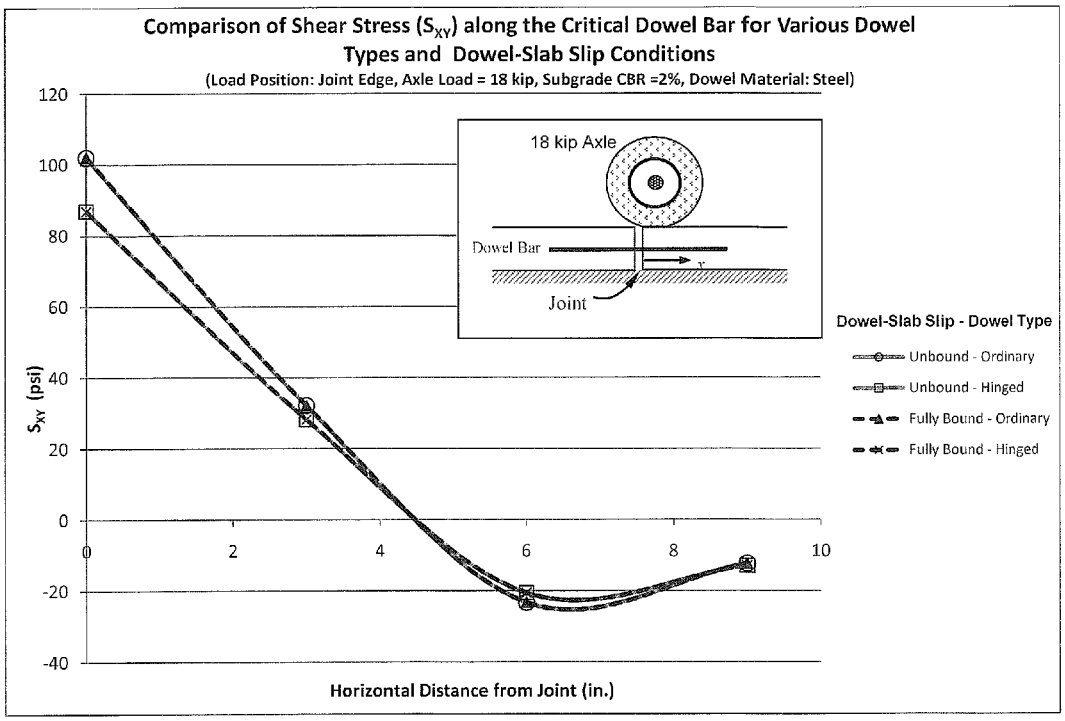
FIGS. 29-32 are graphs of shear stress ($S_{xy}$) versus horizontal distance to joint.

FIG. 29 depicts shear stress ($S_{XY}$) along the critical dowel bars (ordinary and according to the load transfer system) for the following two cases: Unbound: Dowel bars can slip in one of the slabs; Fully Bound: Dowel bars are fully attached to the slabs on both sides As can be seen in FIG. 29, the slab-dowel slip condition did not affect the maximum shear stress. That is, dowel slip conditions do not interfere with the benefits of the load transfer system.

Figure 30:
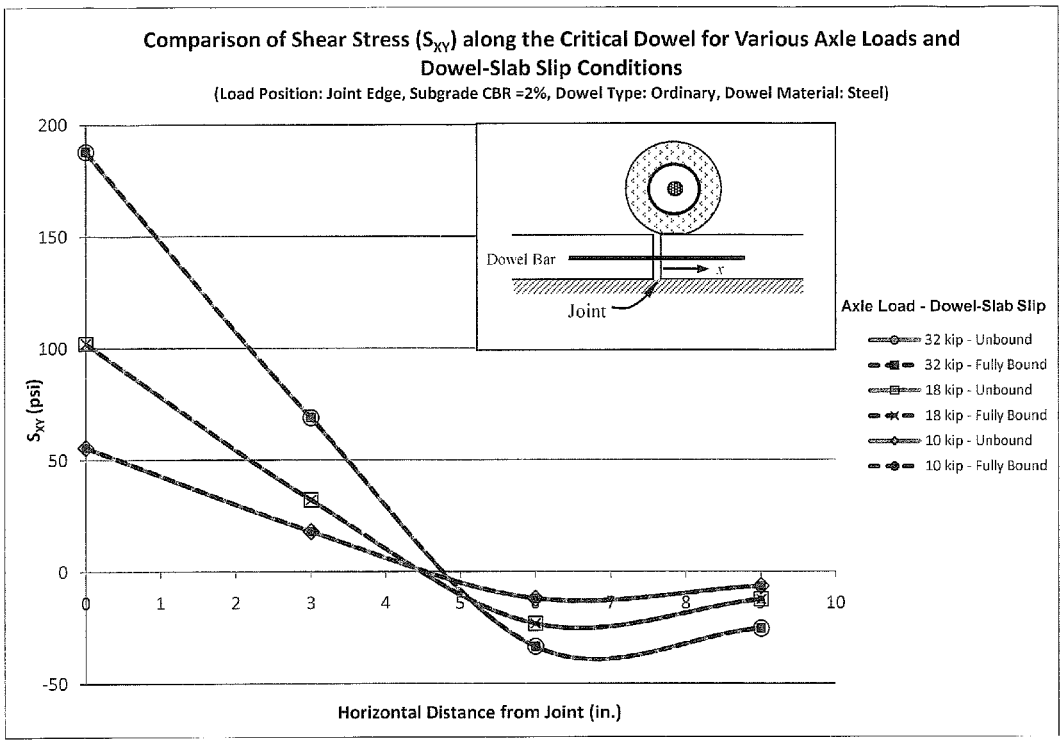

Similar to the FIG. 29, it can also be seen in FIG. 30 that the neutrality of slab-dowel slip conditions with regard to shear stresses held true over a range of traffic loading conditions.

Figure 31:
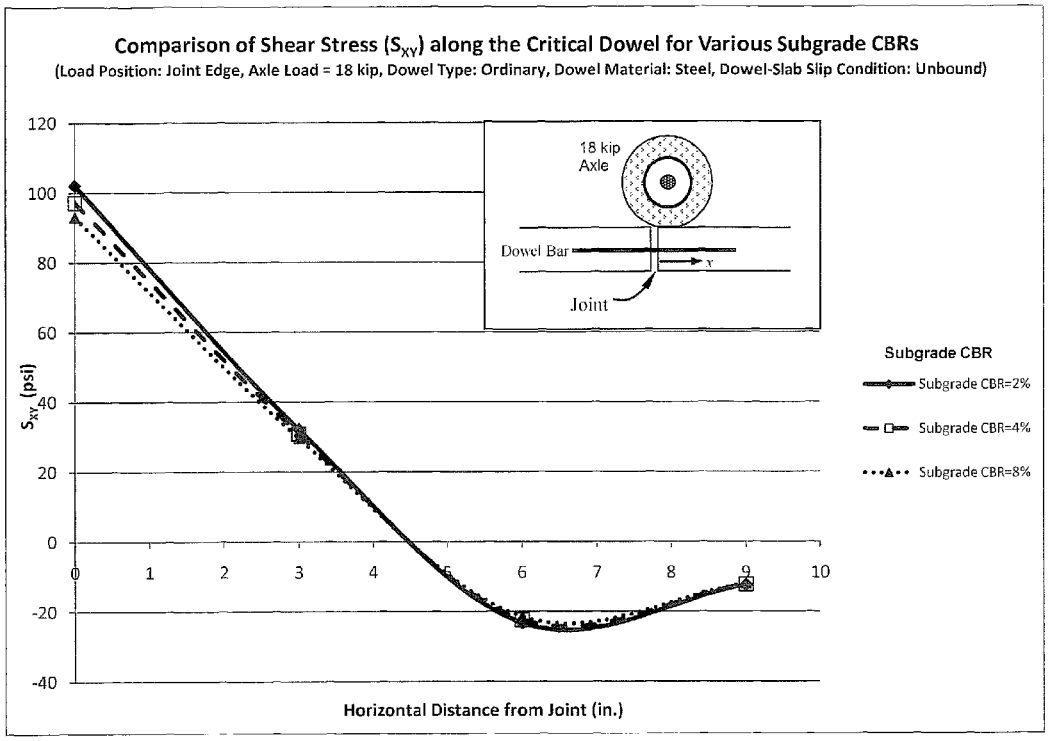

FIG. 31 illustrates the effect of subgrade elasticity modulus on the shear stress along the critical dowel bar when an 18-kip axle was placed at the joint edge. In order to estimate the subgrade modulus from the soil CBR the following equation was used:

$$E(\text{psi})=1500(\text{CBR})$$

The results showed that improving the subgrade stiffness did not lead to a significant reduction in shear stresses. Hence the disclosed load transfer system remains to be the most effective method for reducing shear stresses.

The following two methods for reducing shear stresses in concrete pavements were investigated: 1) Using the disclosed load transfer system; 2) Stabilizing the subgrade by increasing the foundation soil stiffness in conjunction with using ordinary dowels.

Figure 32:
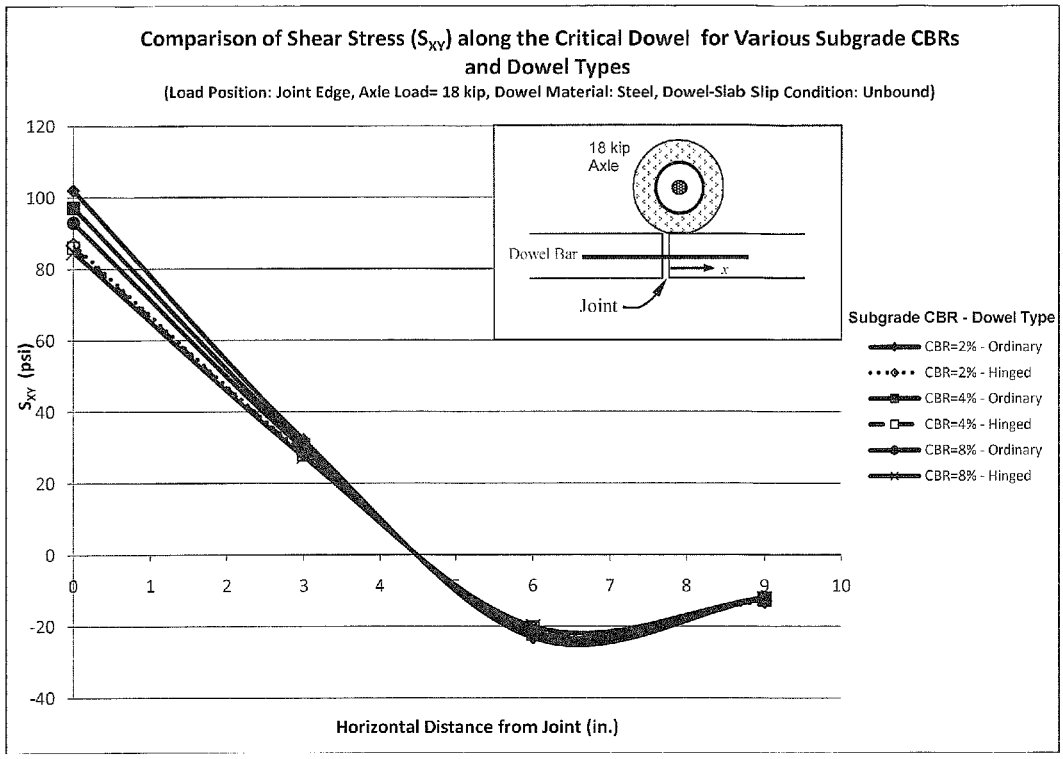

As can be seen in FIG. 32, using the disclosed load transfer system is more effective in reducing the critical shear stresses.

Figure 33:
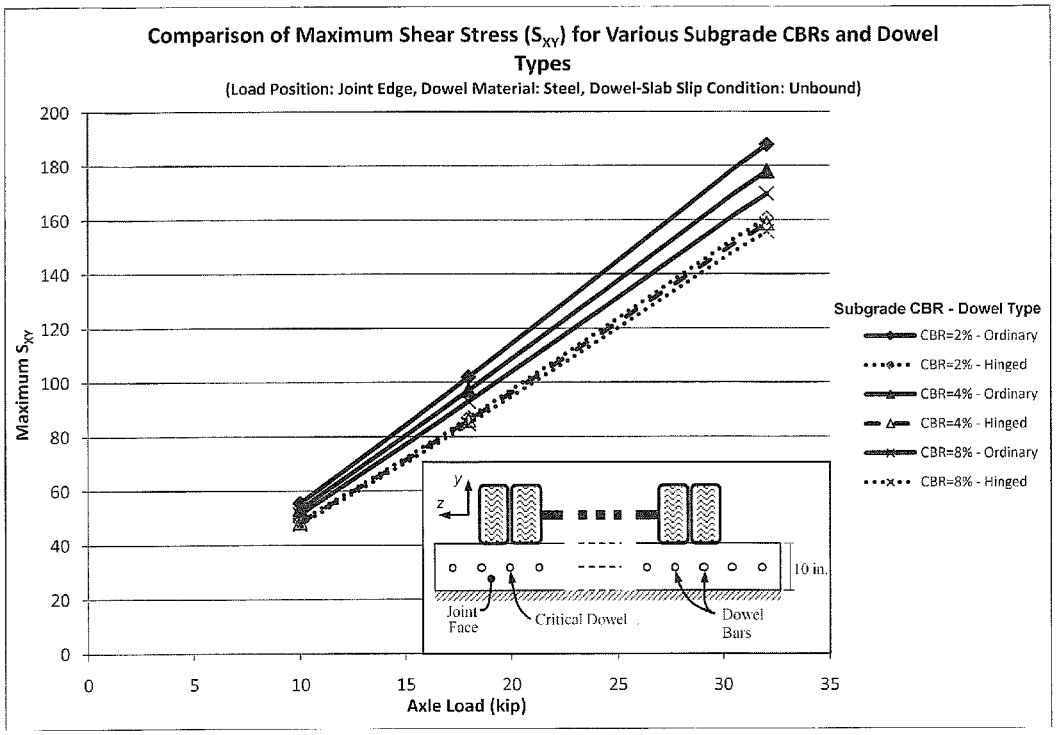
FIG. 33 is a graph of maximum stress ($S_{xy}$) versus axle load.

The previously mentioned two methods for reducing shear stresses were again compared, and the findings are reported in FIG. 33. The analysis showed that using the load transfer system reduced the shear stresses twice as much as subgrade improvement. Considering the fact that subgrade improvement is a more expensive option when compared to the disclosed load transfer system, the choice is clear: the current load transfer system offers the best shear stress reduction at a lower cost.

Figure 34:
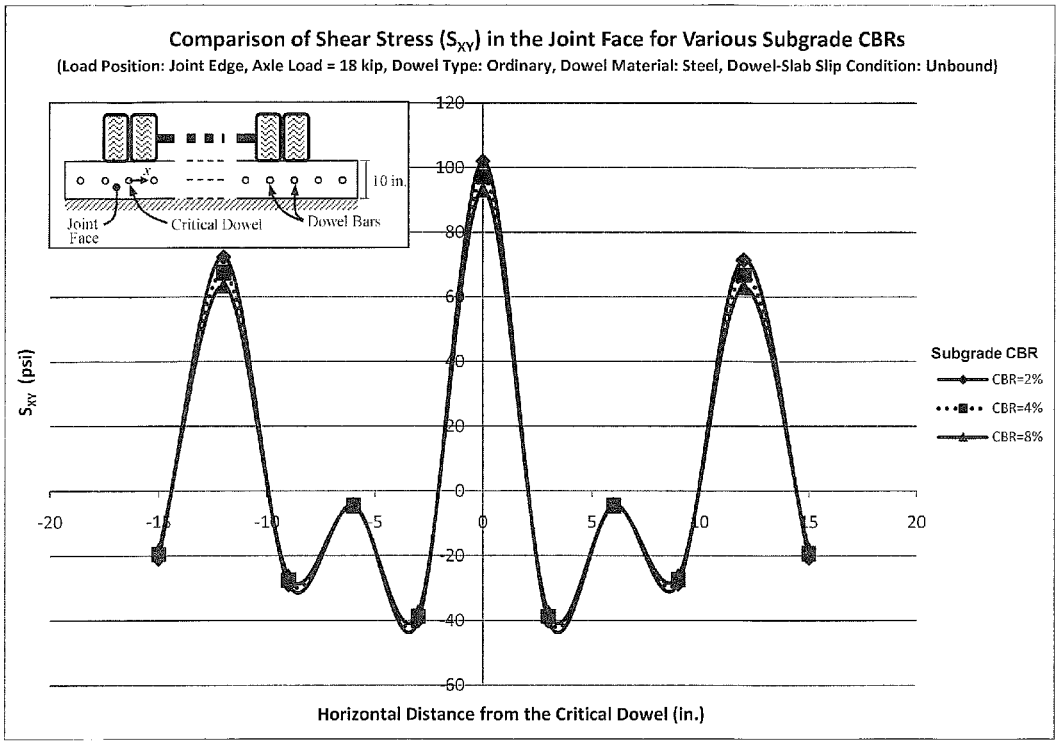
FIG. 34 is a graph of shear stress ($S_{xy}$) versus horizontal distance from critical dowel.

The effect of improving the subgrade CBR on reducing the shear stress level in the joint face is presented in FIG. 34. Improving the subgrade CBR from 2% to 8% did not reduce the shear stresses more than 10 percent. Again, the disclosed load transfer system is a superior option.

Figure 35:
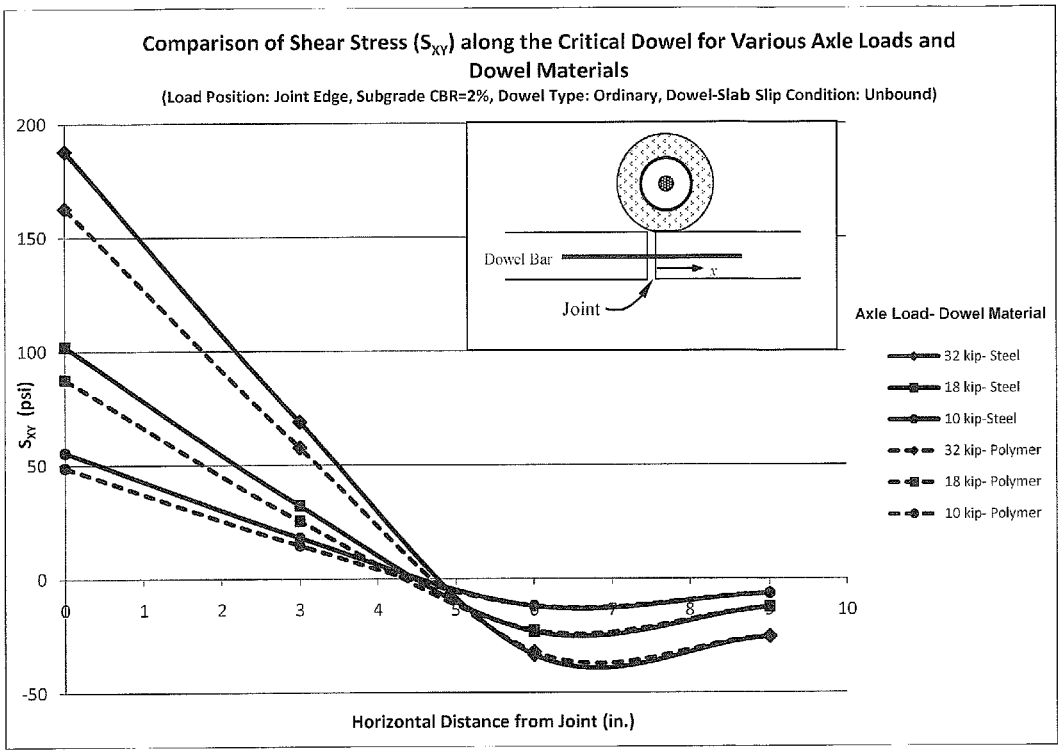
FIGS. 35 and 36 are graphs of shear stress ($S_{xy}$) versus horizontal distance to joint.

FRP dowel bars can also be used in rigid pavement joints. Due to the flexibility of FRP dowel bars, they may behave similar to the disclosed load transfer systems only from the joint rotation point of views. The results of an investigation into their stress performance were presented in FIG. 35. The material properties of Aslan600 GFRP (Glass Fiber Reinforced Polymer) dowel bars made by Hughes Brothers Company were used in this analysis. (Dowel Bar Modulus: $E=5.92\times10^6$ psi). It is important to note that FRP may allow rotation at the slab joint, however, the load transfer efficiency (LTE) of joints with polymer dowel bars is much lower than those with steel dowel bars due lower stiffness of FRP, see [0090]. Additionally, the FRP is more expensive than steel dowel bars.

Figure 36:
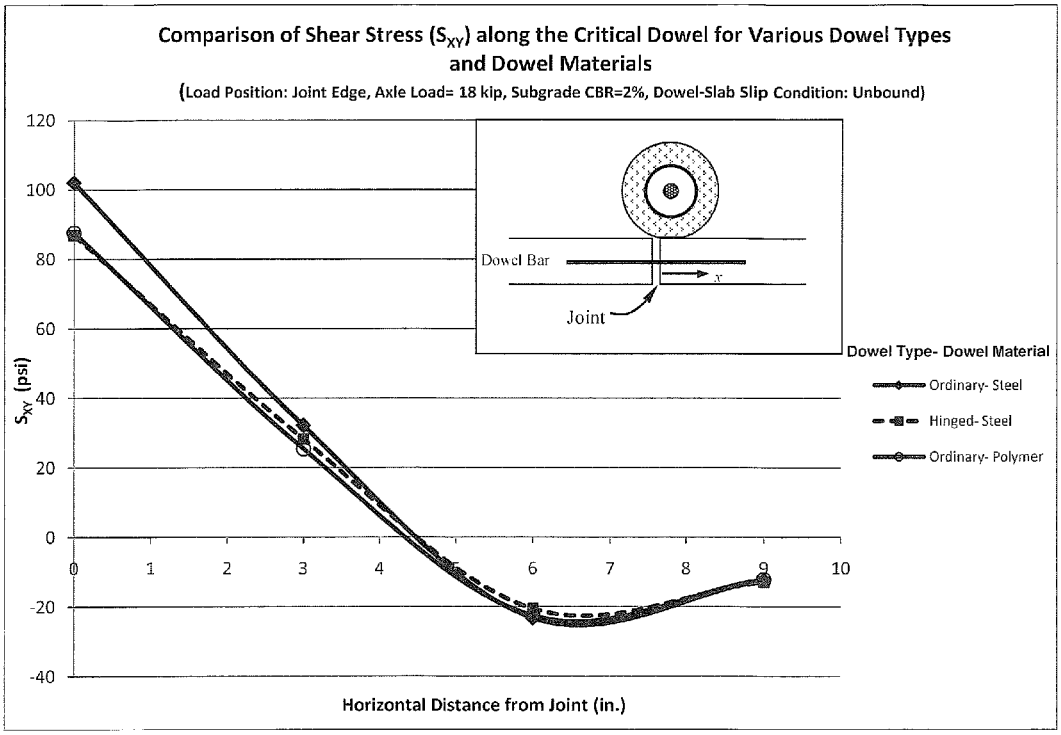

Three dowel options were compared, and the results are presented in FIG. 36.

The polymer and disclosed load transfer system performed similarly in terms of their shear stress reduction benefit. However, it is important to note that the load transfer efficiency (LTE) of joints with polymer dowel bars is much lower than those with steel dowel bars. Hence, using steel dowel bars with the disclosed load transfer system would be the superior option.

Figure 37:
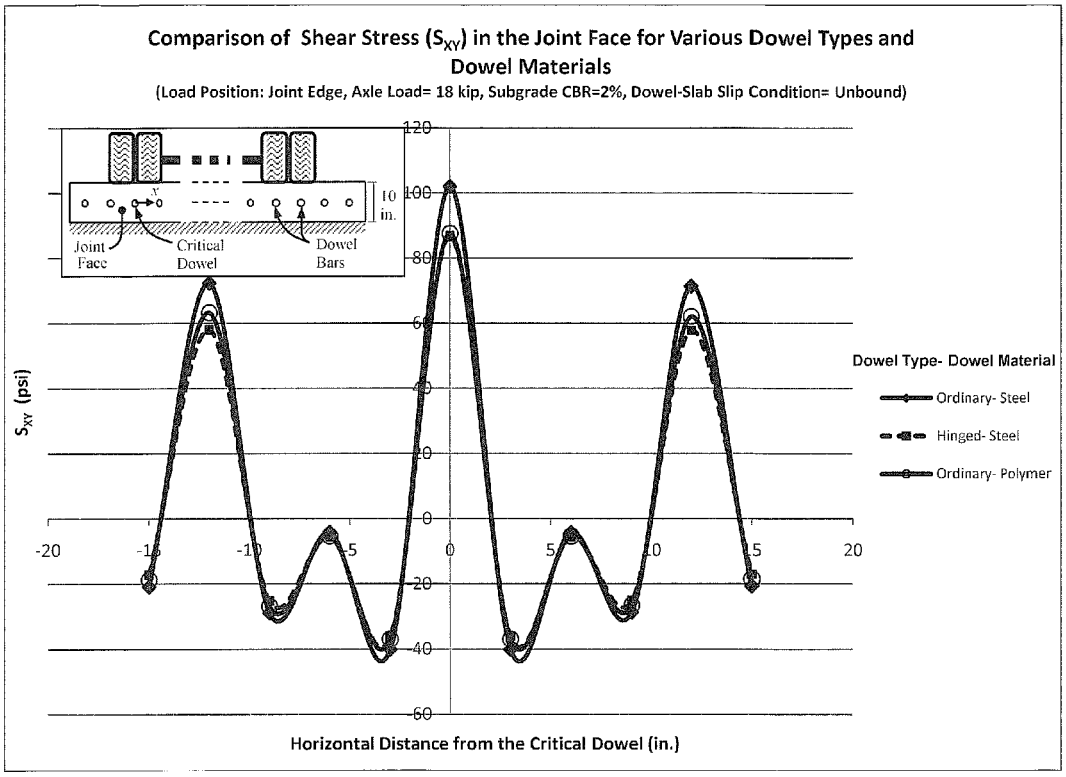
FIG. 37 is a graph of shear stress ($S_{xy}$) versus horizontal distance from critical dowel.

The effect of using FRP versus the disclosed load transfer assembly on shear stress in joint face was compared and reported in FIG. 37. As the distance from the critical dowel increases, the reduction in shear stress ($S_{XY}$) is 5% higher with the disclosed load transfer system.

Figure 38:
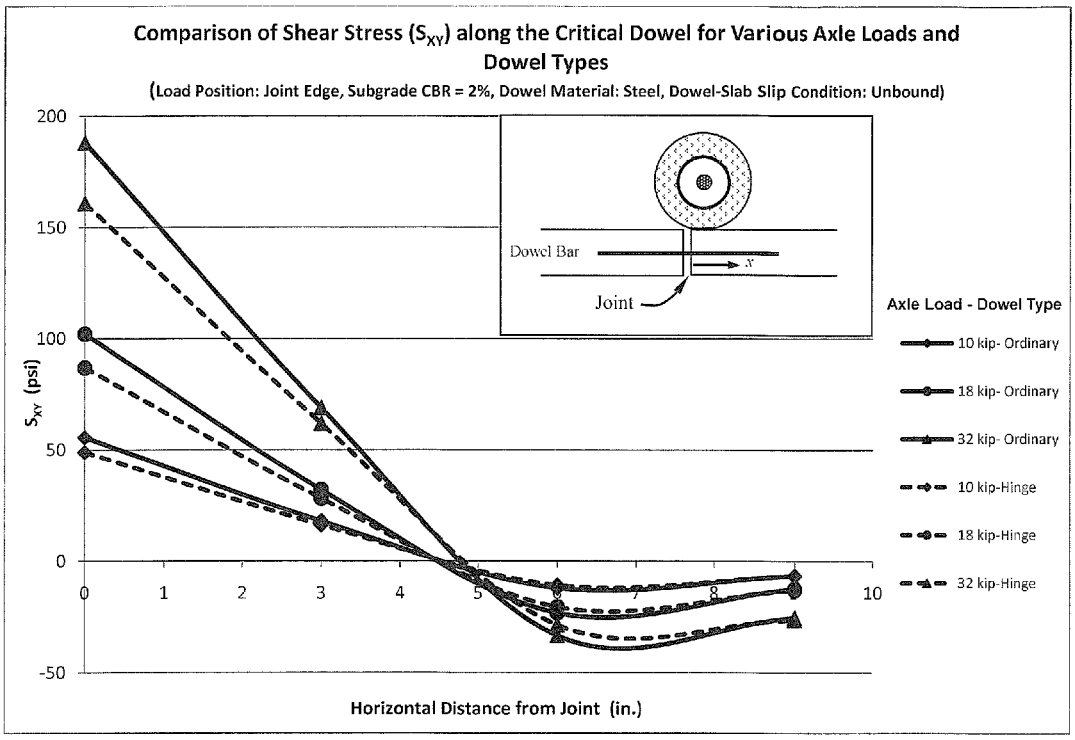
FIG. 38 is a graph of shear stress ($S_{xy}$) versus horizontal distance from joint.

FIG. 38 shows the shear stress along the critical dowel bar for different axle loads. The shear stress reaches its maximum at the joint face. The disclosed load transfer system reduces the shear stress ($S_{XY}$) in the concrete slab. For a weak subgrade (CBR=2%), when a standard 18-kip axle with 125 psi tire pressure is placed at the joint edge, the disclosed load transfer system provides an approximately 15%-20% reduction in the maximum shear stress ($S_{XY}$). Likewise, when the axle load increases to 32-kip with tire pressure of 111 psi, the maximum disclosed load transfer system reduces shear stress by about 15% to about 20% as compared to a joint with ordinary dowel bars.

Figure 39:
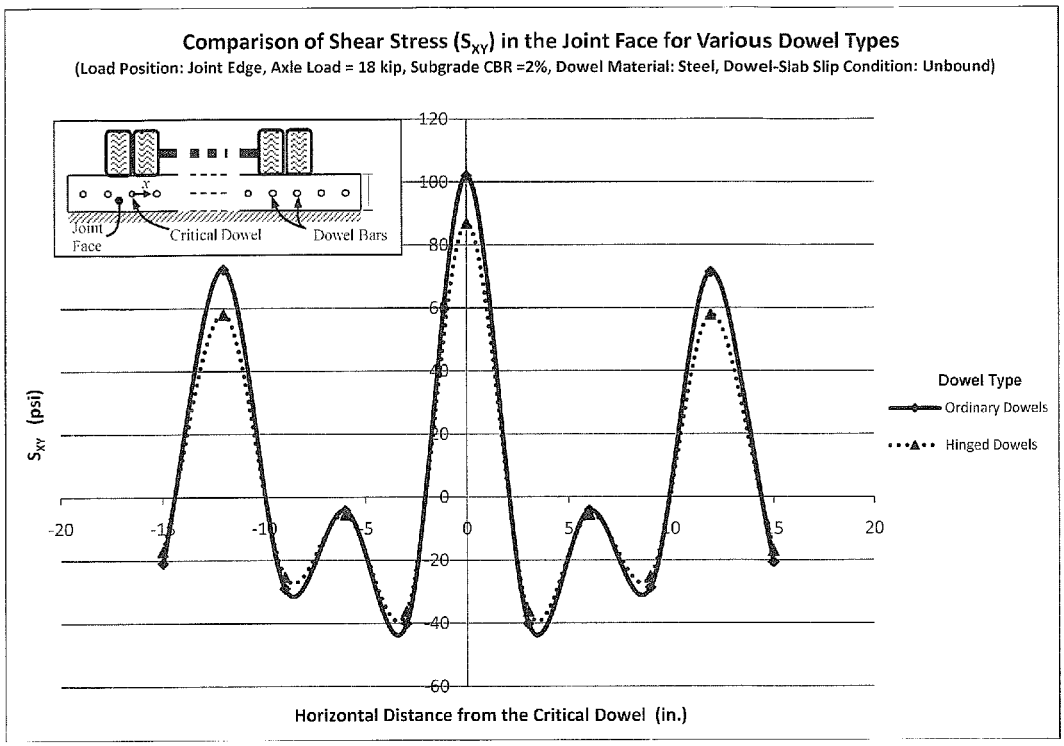
FIG. 39 is a graph of shear stress ($S_{xy}$) versus horizontal distance from critical dowel.

Variation of shear stress along the joint-plane is illustrated in FIG. 39, where the x-axis is assumed to be placed on the centerline of the joint-plane and the origin of the x-axis is assumed to be on the center of the critical dowel bar. The analysis shows that the disclosed load transfer system decreases shear stress ($S_{XY}$) in the joint-plane and along the centerline (where dowel bars are placed). This reduction could prolong the service life of the concrete pavement. The benefit of this reduction in shear stress is more pronounced for heavier vehicles.

Figure 40:
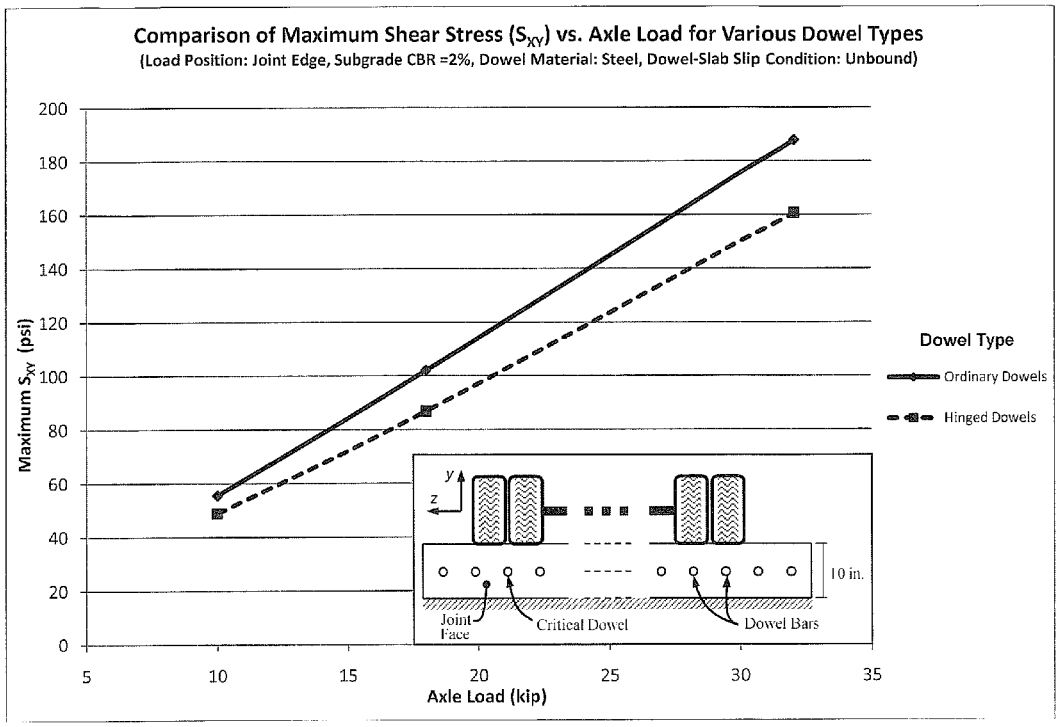
FIGS. 40 and 41 are graphs of maximum stress ($S_{xy}$) versus axle load.

The effect of truck axle load on maximum shear stress is depicted in FIG. 40. The maximum shear stress ($S_{XY}$) increases linearly with the increase in axle load. Again, the benefit of the disclosed load transfer system is even more pronounced for heavier vehicles.

Figure 41:
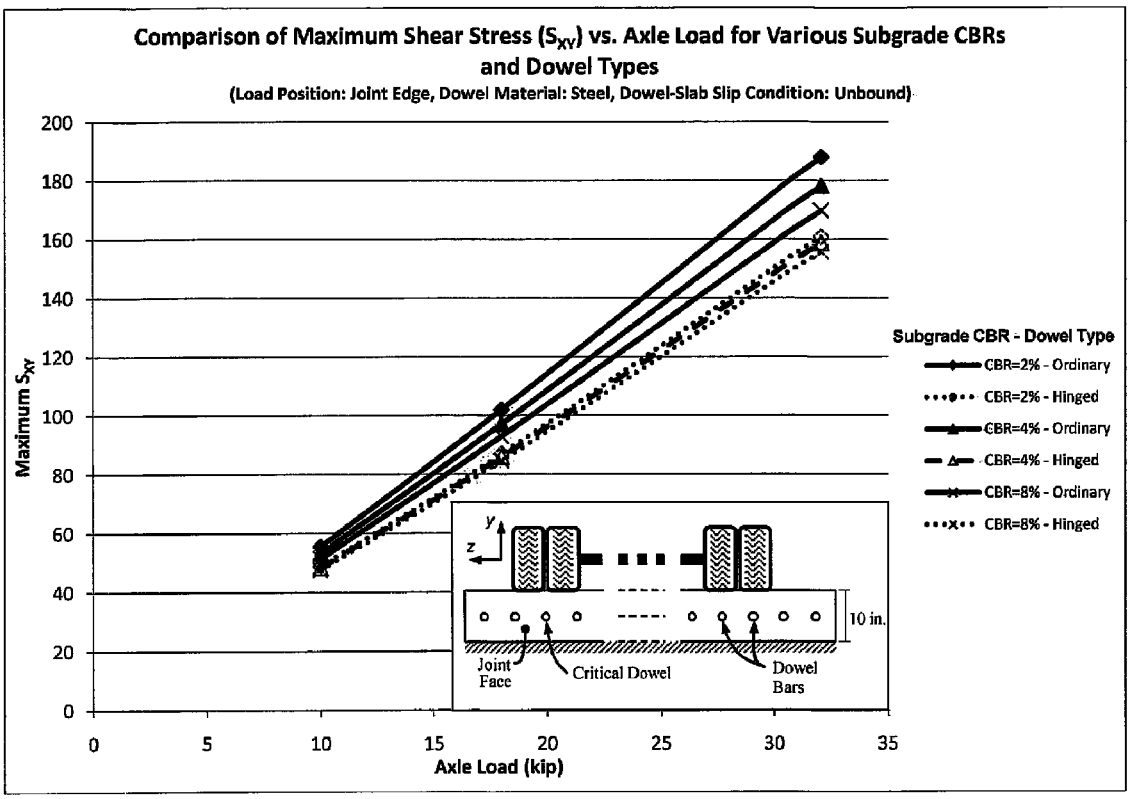

Engineers often stabilize the subgrade soil beneath a concrete pavement in order to improve the longevity of the pavement. Subgrade soil strength is often indexed in terms of its California Bearing Ratio (CBR). The higher CBR number refers to a stronger pavement foundation soil. It is very important to note that FIG. 41 demonstrates that the disclosed load transfer system would have a more significant effect on shear stress reduction than soil stabilization (by a factor of two). This is a major discovery, which further supports the benefits of this new load transfer apparatus.

Critical Shear Stress: According to ACI 318 code, for non-pre-stressed members subjected only to shear and flexure stresses, the concrete shear capacity, $V_C$ is related to concrete compressive strength in the form of the following relationship: $V_C=2\sqrt{f'_C}b_w d$ Therefore, the permitted shear stress for concrete slabs (assuming a uniformly distributed stress with a typical concrete compressive strength of $f_C$=2000 psi to 4000 psi) would approximately be $$v_C=2\sqrt{2000\text{to}4000}=89 \text{ to } 126 \text{ psi.}$$

In Table 2.1, the permitted shear stress in the concrete slab is compared to the maximum critical shear stress obtained from the aforementioned calculations. This table shows that the disclosed load transfer system may make a significant contribution to moderating the maximum shear stresses. It should be noted that the finite element model was generated based upon the worst-case scenario, and hence the maximum shear stresses are very high. For example, the load transfer between slabs offered by aggregate interlock at the joint was assumed to be zero. Additionally, the opening of the slab joint was assumed to be large enough to allow slab rotation without any joint interface contact. These scenarios exposed the disclosed load transfer assembly to the most severe loading conditions without any assistance from the slab-joint interface. In all cases, as presented in Table 2.1, the disclosed load transfer system resulted in a lower shear stress in concrete.

TABLE 2.1

Maximum Shear Stress in Concrete Slab for a Single Axle Load Applied at Joint Edge

| | | Maximum Shear Stress (psi) | |
|---|---|---|---|
| Subgrade CBR | Single Axle Load (kip) | Ordinary Dowel | Disclosed Load Transfer System |
| 2% | 10 | 55 | 48 |
| | 18 | 102 | 87 |
| | 32 | 188 | 160 |
| 4% | 10 | 53 | 48 |
| | 18 | 97 | 86 |
| | 32 | 178 | 159 |
| 8% | 10 | 51 | 48 |
| | 18 | 93 | 85 |
| | 32 | 170 | 156 |
| Maximum Allowed Shear Stress (psi) (according to ACI 318) | | 89 to 126 | |

The pavement modeling analysis showed that the proposed load transfer system reduces the shear stresses in the concrete slab by 15%-20% when compared to ordinary dowel bars. This reduction in stress results in longer lasting concrete pavements. Furthermore, the stress reduction benefit of the proposed load transfer system far exceeds the stress reduction due to foundation soil improvements. It is important to note that foundation soil improvement can only be made during brand new construction projects. By contrast, the disclosed load transfer system may be installed at the time of new construction as well as retrofit later in the life of the concrete pavement. This flexibility in application translates into real cost savings.

Relieving the Curling Effect: Daily temperature cycles produce curling of concrete slabs, which leads to damage at concrete joints. This damage process is cumulative, and it adds up to the traffic induced damage. Thus, a rotatable load transfer system, as disclosed herein, would help to reduce the stresses induced due to curling and traffic. The advantage of a hinged dowel bar load transfer system comes into play when a given slab can rotate with respect to its adjacent slab, while it continues to carrying vertical loads induced by traffic. Such flexibility at the slab joint is the reason for a reduction in concrete shear stresses.

In summary, numerous benefits result from employing the concepts of the present invention. The length of the elongated spine or hinge 405 and the optional ridge both function to insure proper alignment of the apparatus 400 with the joint between adjacent slabs thereby insuring proper function of the apparatus and relief of stress in the slabs. Any misalignment can bind and defeat proper operation of the hinge and significantly reduce or even eliminate stress relief benefits.

The foregoing description of the preferred embodiment of the present device has been presented for purposes of illustration and description. It is not intended to be exhaustive or to limit the device to the precise form disclosed. Obvious modifications or variations are possible in light of the above teachings. The embodiments were chosen and described to provide the best illustration of the principles of the device and its practical application to thereby enable one of ordinary skill in the art to utilize the device in various embodiments and with various modifications as are suited to the particular use contemplated. All such modifications and variations are within the scope of the device as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A load transfer apparatus for accommodating movement between adjacent concrete slabs, said apparatus comprising:

a first dowel bar, a second dowel bar and a freely rotating elongated hinge between said first and second dowel bars wherein said elongated hinge has a length $L_H$ and said first and second dowel bars have a width W where $L_H$ is at least two times longer than W and wherein said first dowel bar includes a first cylindrical element and said second dowel bar includes a second cylindrical element, said first cylindrical element nesting in said second cylindrical element so as to form said hinge.

2. The apparatus of claim 1, further including a first dowel bar sleeve and a second dowel bar sleeve, said first dowel bar sleeve being held in a first concrete slab of said adjacent concrete slabs and said second dowel bar sleeve being held in a second concrete slab of said adjacent concrete slabs, at least a portion of said first dowel bar being slidingly received in said first sleeve and at least a portion of said second dowel bar being slidingly received in said second sleeve.

3. The apparatus of claim 1, wherein said elongated hinge has a length $L_H$ and said dowel bar has a length $L_B$ where $L_H > L_B$.

4. The apparatus of claim 1, further including a bolster that supports said dowel bar during pouring and setting of said first and second concrete slabs while allowing for hinged movement of said dowel bar following setting of said first and second concrete slabs.

5. The apparatus of claim 4, wherein said hinge includes at least one projecting ridge.

6. The apparatus of claim 5, further including a spacer connected to and projecting from said ridge.

7. The apparatus of claim 6, wherein said at least one projecting ridge projects in a vertical plane in a joint between said first concrete slab and said second concrete slab.

8. The apparatus of claim 1, wherein said second cylindrical element includes a slot and said first end extends through said slot.

9. A load transfer apparatus for accommodating movement between adjacent concrete slabs, said apparatus comprising:

a spine and a plurality of dowel bars projecting from said spine where said spine comprises an elongated, freely rotating hinge.

10. The apparatus of claim 9, wherein said hinge includes a first tube and a second tube wherein said first tube nests within said second tube while allowing for free rotation with respect to said second tube.

11. The apparatus of claim 10, further including a cap at each end of said second tube.

12. The apparatus of claim 10, wherein each of said plurality of dowel bars includes a first end and a second end, said first end of each dowel bar being connected to said first tube and said second end of each dowel bar being connected to said second tube.

13. The apparatus of claim 12, wherein said second tube includes a slot and said first end of each dowel bar extends through said slot in said second tube.

14. The apparatus of claim 13, further including dowel bar sleeves held in said adjacent concrete slabs, said dowel bars being slidingly received in said dowel bar sleeves.

15. The apparatus of claim 14, further including at least one ridge projecting from said second tube in a substantially vertical plane in a joint formed between a first concrete slab and a second concrete slab of said adjacent concrete slabs.

16. The apparatus of claim 9, including coating said hinge and dowel bars with a low friction, non-stick material.

17. A load transfer apparatus for accommodating movement between adjacent concrete slabs comprising:

a spine in the form of an elongated hinge having a longitudinal axis A;

a first dowel at a first point of said spine, said first dowel being disposed on a first side of said spine and radially projecting therefrom a 00a second dowel at a second point on said spine, said second dowel being disposed on a second side of said spine and radially projecting therefrom;

a third dowel at a third point on said spine, said third dowel being disposed on said first side of said spine and radially projecting therefrom;

a fourth dowel at a fourth point on said spine, said fourth dowel being disposed on said second side of said spine and radially projecting therefrom, wherein said spine hinges to accommodate movement between concrete slabs connected to said first, second, third and fourth.

18. The apparatus of claim 17, wherein said adjacent concrete slabs are separated by a joint and said spine and longitudinal axis are aligned with said joint between said adjacent slabs.

19. A load transfer apparatus for accommodating movement between a first concrete slab and an adjacent second concrete slab, said apparatus comprising:

a first dowel bar and a second dowel bar and a freely rotating hinge provided between said first and second dowel bars;

a first dowel bar sleeve for engaging said first concrete slab, at least a portion of said first dowel bar being slidingly received in said first dowel bar sleeve; and a second dowel bar sleeve for engaging said second concrete slab, at least a portion of said second dowel bar being slidingly received in said second dowel bar sleeve;

whereby said dowel bar freely hinges and slides with respect to said first concrete slab and said second concrete slab so as to better accommodate shear stress, as well as expansion and contraction of said first and second concrete slabs.

20. The apparatus of claim 19, wherein said first and second dowel bars include a coating of low-friction, non-stick material.

* * * * *